US009200500B2

(12) United States Patent
Roddy et al.

(10) Patent No.: US 9,200,500 B2
(45) Date of Patent: Dec. 1, 2015

(54) USE OF SENSORS COATED WITH ELASTOMER FOR SUBTERRANEAN OPERATIONS

(71) Applicant: Halliburton Energy Services, Inc., Houston, TX (US)

(72) Inventors: Craig W. Roddy, Duncan, OK (US); Ricky L. Covington, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 343 days.

(21) Appl. No.: 13/664,286

(22) Filed: Oct. 30, 2012

(65) Prior Publication Data

US 2013/0062068 A1 Mar. 14, 2013

Related U.S. Application Data

(63) Continuation-in-part of application No. 12/618,067, filed on Nov. 13, 2009, now Pat. No. 8,342,242, which is a continuation-in-part of application No. 11/695,329, filed on Apr. 2, 2007, now Pat. No. 7,712,527.

(51) Int. Cl.

| | |
|---|---|
| ***E21B 47/017*** | (2012.01) |
| ***E21B 33/13*** | (2006.01) |
| ***E21B 43/25*** | (2006.01) |
| ***E21B 47/00*** | (2012.01) |
| ***E21B 47/01*** | (2012.01) |

(Continued)

(52) U.S. Cl.

CPC ..... *E21B 33/13* (2013.01); *E21B 43/25* (2013.01); *E21B 47/0005* (2013.01); *E21B 47/01* (2013.01); *E21B 47/10* (2013.01); *E21B 47/122* (2013.01)

(58) Field of Classification Search

CPC ..... E21B 47/12; E21B 47/122
USPC ..... 166/66, 65.1, 255.1, 250.1, 305.1
See application file for complete search history.

(56) References Cited

U.S. PATENT DOCUMENTS

| | | | |
|---|---|---|---|
| 3,239,005 | A | 3/1966 | Bodine, Jr. |
| 3,930,220 | A | 12/1975 | Shawhan |

(Continued)

FOREIGN PATENT DOCUMENTS

| | | | |
|---|---|---|---|
| EP | 1830035 | A1 | 9/2007 |
| EP | 2129867 | | 10/2008 |

(Continued)

OTHER PUBLICATIONS

Foreign communication from a related counterpart application—International Search Report and Written Opinion, PCT/US2014/030286, Oct. 10, 2014, 8 pages.

(Continued)

*Primary Examiner* — Kenneth L Thompson
(74) *Attorney, Agent, or Firm* — Craig W. Roddy; Baker Botts L.L.P.

(57) ABSTRACT

A method comprising placing a composition comprising a wellbore servicing fluid and a Micro-Electro-Mechanical System (MEMS) sensor in a subterranean formation, whereby the MEMS sensor is coated with an elastomer. The elastomer-coated MEMS sensor is used to detect one or more parameters, including a compression or swelling of the elastomer, an expansion of the elastomer, or a change in density of the composition.

20 Claims, 4 Drawing Sheets

(51) Int. Cl.
*E21B 47/10* (2012.01)
*E21B 47/12* (2012.01)

(56) References Cited

U.S. PATENT DOCUMENTS 4,156,229 A 5/1979 Shawhan
4,234,344 A 11/1980 Tinsley et al.
4,298,970 A 11/1981 Shawhan et al.
4,390,975 A 6/1983 Shawhan
4,512,401 A 4/1985 Bodine
4,547,468 A * 10/1985 Jones et al. ..... 501/33
4,561,300 A * 12/1985 O'Brien ..... 73/152.03
4,653,587 A 3/1987 Bodine
4,736,794 A 4/1988 Bodine
5,121,795 A 6/1992 Ewert et al.
5,123,487 A 6/1992 Harris et al.
5,127,473 A 7/1992 Harris et al.
5,213,161 A 5/1993 King et al.
5,220,960 A 6/1993 Totten et al.
5,281,270 A 1/1994 Totten et al.
5,298,069 A 3/1994 King et al.
5,346,012 A 9/1994 Heathman et al.
5,437,329 A 8/1995 Brooks et al.
5,524,709 A 6/1996 Withers
5,588,488 A 12/1996 Vijn et al.
5,627,749 A 5/1997 Waterman et al.
5,839,508 A 11/1998 Tubel et al.
5,929,437 A * 7/1999 Elliott et al. ..... 250/259
5,991,602 A 11/1999 Sturm
5,995,477 A 11/1999 Smith et al.
6,041,861 A 3/2000 Mandal et al.
6,063,738 A 5/2000 Chatterji et al.
6,101,447 A 8/2000 Poe, Jr.
6,125,935 A 10/2000 Shahin, Jr.
6,150,601 A 11/2000 Schnatzmeyer et al.
6,234,257 B1 5/2001 Ciglenec et al.
6,241,028 B1 6/2001 Bijleveld et al.
6,244,342 B1 6/2001 Sullaway et al.
6,269,685 B1 8/2001 Oden
6,324,904 B1 12/2001 Ishikawa et al.
6,357,278 B1 * 3/2002 Sivavec et al. ..... 73/24.01
6,367,550 B1 4/2002 Chatterji et al.
6,374,913 B1 4/2002 Robbins et al.
6,429,784 B1 8/2002 Beique et al.
6,434,084 B1 8/2002 Schultz
6,443,228 B1 9/2002 Aronstam et al.
6,457,524 B1 10/2002 Roddy
6,485,560 B1 11/2002 Scherer et al.
6,538,576 B1 * 3/2003 Schultz et al. ..... 340/854.6
6,547,871 B2 4/2003 Chatterji et al.
6,597,175 B1 7/2003 Brisco
6,664,215 B1 12/2003 Tomlinson
6,693,554 B2 2/2004 Beique et al.
6,697,738 B2 2/2004 Ravi et al.
6,702,044 B2 3/2004 Reddy et al.
6,712,138 B2 3/2004 Mandal
6,722,433 B2 4/2004 Brothers et al.
6,722,434 B2 4/2004 Reddy et al.
6,735,630 B1 5/2004 Gelvin et al.
6,745,833 B2 6/2004 Aronstam et al.
6,766,141 B1 7/2004 Briles et al.
6,775,578 B2 8/2004 Couet et al.
6,789,619 B2 9/2004 Carlson et al.
6,802,373 B2 10/2004 Dillenbeck et al.
6,802,374 B2 10/2004 Edgar et al.
6,817,412 B2 11/2004 Haase
6,823,271 B1 11/2004 Foss
6,823,940 B2 11/2004 Reddy et al.
6,834,722 B2 12/2004 Vacik et al.
6,839,000 B2 1/2005 Das et al.
6,847,034 B2 1/2005 Shah et al.
6,848,519 B2 2/2005 Reddy et al.
6,891,477 B2 5/2005 Aronstam
6,898,529 B2 5/2005 Gao et al.
6,904,366 B2 6/2005 Patzek et al.
6,915,848 B2 7/2005 Thomeer et al.
6,920,929 B2 7/2005 Bour
6,922,637 B2 7/2005 Ravi et al.
6,925,392 B2 8/2005 McNeil, III et al.
6,935,425 B2 * 8/2005 Aronstam ..... 166/250.11
6,976,535 B2 12/2005 Aronstam et al.
6,994,167 B2 2/2006 Ramos et al.
6,995,677 B2 2/2006 Aronstam et al.
7,003,405 B1 2/2006 Ho
7,004,021 B2 2/2006 Bilby et al.
7,036,363 B2 5/2006 Yogeswaren
7,036,586 B2 5/2006 Roddy et al.
7,038,470 B1 5/2006 Johnson
7,040,404 B2 5/2006 Brothers et al.
7,044,222 B2 5/2006 Tomlinson
7,046,164 B2 5/2006 Gao et al.
7,066,256 B2 6/2006 Dillenbeck et al.
7,066,284 B2 6/2006 Wylie et al.
7,077,203 B1 7/2006 Roddy et al.
7,082,993 B2 8/2006 Ayoub et al.
7,104,116 B2 9/2006 Discenzo
7,107,154 B2 9/2006 Ward
7,116,542 B2 10/2006 Lerche et al.
7,133,778 B2 11/2006 Ravi et al.
7,140,434 B2 11/2006 Chouzenoux et al.
7,140,437 B2 11/2006 McMechan et al.
7,145,473 B2 12/2006 Wisler et al.
7,152,466 B2 12/2006 Ramakrishnan et al.
7,156,174 B2 1/2007 Roddy et al.
7,159,653 B2 1/2007 Vold
7,174,962 B1 2/2007 Roddy et al.
7,213,647 B2 5/2007 Brothers et al.
7,225,879 B2 6/2007 Wylie et al.
7,303,014 B2 12/2007 Reddy et al.
7,357,181 B2 4/2008 Webb et al.
7,389,819 B2 6/2008 Oyeneyin et al.
7,392,697 B2 7/2008 Chikenji et al.
7,400,262 B2 7/2008 Chemali et al.
7,434,457 B2 10/2008 Goodwin et al.
7,453,768 B2 11/2008 Hall et al.
7,455,108 B2 11/2008 Jenkins et al.
7,461,547 B2 12/2008 Terabayashi et al.
7,482,309 B2 1/2009 Ravi et al.
7,493,962 B2 2/2009 Sheffield
7,543,635 B2 * 6/2009 East et al. ..... 166/250.17
7,543,642 B2 6/2009 Reddy et al.
7,581,434 B1 9/2009 Discenzo et al.
7,617,879 B2 11/2009 Anderson et al.
7,631,697 B2 12/2009 Bhavsar
7,636,671 B2 12/2009 Caveny et al.
7,647,979 B2 1/2010 Shipley et al.
7,673,679 B2 3/2010 Harrison et al.
7,712,527 B2 5/2010 Roddy
7,717,180 B2 5/2010 Badalamenti et al.
7,749,942 B2 7/2010 Ravi et al.
7,750,808 B2 7/2010 Masino et al.
7,784,339 B2 8/2010 Cook et al.
7,832,263 B2 11/2010 Rensel et al.
7,841,249 B2 * 11/2010 Tormoen ..... 73/866.5
7,866,393 B2 1/2011 Badalamenti et al.
7,875,455 B1 1/2011 Li et al.
7,878,245 B2 2/2011 Ravi et al.
7,986,218 B2 7/2011 Watters et al.
7,991,680 B2 8/2011 Livesay et al.
8,083,849 B2 12/2011 Lewis et al.
8,162,050 B2 4/2012 Roddy et al.
8,162,055 B2 4/2012 Lewis et al.
8,168,570 B2 5/2012 Barron et al.
8,202,824 B2 6/2012 Reddy et al.
8,269,648 B2 9/2012 Benischek et al.
8,279,713 B2 10/2012 Mickael et al.
8,291,975 B2 10/2012 Roddy et al.
8,297,352 B2 10/2012 Roddy et al.
8,297,353 B2 10/2012 Roddy et al.
8,302,686 B2 11/2012 Roddy et al.
8,316,936 B2 11/2012 Roddy et al.
8,318,099 B2 11/2012 Potyrailo et al.
8,436,743 B2 5/2013 Auzerais et al.
8,534,124 B2 * 9/2013 Vornbrock et al. ..... 73/152.16

(56) References Cited

U.S. PATENT DOCUMENTS

| | | | | |
|---|---|---|---|---|
| 8,584,519 | B2 * | 11/2013 | Maida et al. | 73/152.54 |
| 9,074,464 | B2 * | 7/2015 | Hinkie et al. | |
| 2002/0007948 | A1 * | 1/2002 | Bayne et al. | 166/278 |
| 2002/0196993 | A1 | 12/2002 | Schroeder | |
| 2003/0029611 | A1 | 2/2003 | Owens | |
| 2003/0205376 | A1 | 11/2003 | Ayoub et al. | |
| 2004/0149431 | A1 * | 8/2004 | Wylie et al. | 166/242.1 |
| 2005/0006020 | A1 | 1/2005 | Jose Zitha et al. | |
| 2005/0055162 | A1 | 3/2005 | Gao et al. | |
| 2005/0109098 | A1 * | 5/2005 | DiFoggio | 73/152.55 |
| 2005/0159494 | A1 | 7/2005 | Dobbs | |
| 2005/0224123 | A1 | 10/2005 | Baynham et al. | |
| 2006/0013065 | A1 | 1/2006 | Varsamis et al. | |
| 2006/0018190 | A1 | 1/2006 | Brooks | |
| 2006/0035790 | A1 * | 2/2006 | Okell et al. | 507/269 |
| 2006/0086503 | A1 | 4/2006 | Reddy et al. | |
| 2007/0027245 | A1 * | 2/2007 | Vaidya et al. | 524/424 |
| 2007/0090927 | A1 | 4/2007 | Potyrailo et al. | |
| 2007/0107908 | A1 * | 5/2007 | Vaidya et al. | 166/376 |
| 2007/0131414 | A1 | 6/2007 | Calderoni et al. | |
| 2008/0007421 | A1 | 1/2008 | Liu et al. | |
| 2008/0196889 | A1 | 8/2008 | Bour et al. | |
| 2009/0033516 | A1 | 2/2009 | Alteirac et al. | |
| 2009/0120168 | A1 | 5/2009 | Harrison et al. | |
| 2010/0039898 | A1 | 2/2010 | Gardner et al. | |
| 2010/0050905 | A1 | 3/2010 | Lewis et al. | |
| 2010/0051266 | A1 | 3/2010 | Roddy et al. | |
| 2010/0139386 | A1 | 6/2010 | Taylor | |
| 2010/0212891 | A1 * | 8/2010 | Stewart et al. | 166/250.12 |
| 2011/0187556 | A1 | 8/2011 | Roddy et al. | |
| 2011/0199228 | A1 | 8/2011 | Roddy et al. | |
| 2011/0277996 | A1 * | 11/2011 | Cullick et al. | 166/250.12 |
| 2011/0315377 | A1 | 12/2011 | Rioufol | |
| 2012/0055669 | A1 | 3/2012 | Levin et al. | |
| 2012/0081696 | A1 * | 4/2012 | Boersma et al. | 356/73.1 |

FOREIGN PATENT DOCUMENTS

| | | | |
|---|---|---|---|
| EP | 2336487 | A1 | 6/2011 |
| EP | 2343434 | A1 | 7/2011 |
| EP | 2489828 | A1 | 8/2012 |
| EP | 2489829 | A1 | 8/2012 |
| GB | 2367133 | A | 3/2002 |
| GB | 2391565 | A | 2/2004 |
| GB | 2431400 | A | 4/2007 |
| WO | 9966172 | A1 | 12/1999 |
| WO | 0206628 | A1 | 1/2002 |
| WO | 2006136635 | A2 | 12/2006 |
| WO | 2006136635 | A3 | 12/2006 |
| WO | 2007034273 | A1 | 3/2007 |
| WO | 2008119963 | A1 | 10/2008 |
| WO | 2009008735 | A1 | 1/2009 |
| WO | 2011023938 | A1 | 3/2011 |
| WO | 2011023938 | A9 | 3/2011 |
| WO | 2011023942 | A2 | 3/2011 |
| WO | 2011023942 | A3 | 3/2011 |
| WO | 2011058324 | A1 | 5/2011 |
| WO | 2012114068 | A2 | 8/2012 |
| WO | 2012114068 | A3 | 8/2012 |

OTHER PUBLICATIONS

Foreign communication from a related counterpart application—International Preliminary Report on Patentability, PCT/GB2012/000179, Aug. 21, 2013, 8 pages.

Office Action dated Jun. 27, 2014 (59 pages), U.S. Appl. No. 13/031,515, filed Feb. 21, 2011.

Foreign communication from a related counterpart application—International Search Report and Written Opinion, PCT/GB2008/000179, Jun. 24, 2013, 12 pages.

Office Action dated Aug. 5, 2014 (41 pages), U.S. Appl. No. 13/031,519, filed Feb. 21, 2011.

Foreign communication from a related counterpart application—International Search Report and Written Opinion, PCT/US2013/061611, Sep. 10, 2014, 9 pages.

Office Action dated Jan. 29, 2014 (79 pages), U.S. Appl. No. 13/031,519, filed Feb. 21, 2011.

Advanced Design Consulting USA brochure entitled "MEMS concrete monitoring system," http://www.adc9001.com/index/php?src=memsconcrete&print=1, 2006, 1 page, Advanced Design Consulting USA, Inc.

Drumheller, D. S., "An overview of acoustic telemetry," 7 pages.

Foreign communication from a related counterpart application—International Search Report and Written Opinion, PCT/GB2008/001084, Jul. 8, 2008, 10 pages.

Foreign communication from a related counterpart application—Examination Report, European patent application No. 08718914.8, May 4, 2010, 5 pages.

Halliburton brochure entitled "Spherelite™ cement additive," Nov. 2006, 1 page, Halliburton.

International Road Dynamics brochure entitled "Concrete maturity monitor: wireless technology in the palm of your hand," Jun. 2002, 5 pages, International Road Dynamics Inc.

NASA, "Ultrasonic testing of aerospace materials," Preferred Reliability Practices, Practice No. PT-TE-1422, 6 pages.

Ong, Keat Ghee, et al., "A wireless, passive carbon nanotube-based gas sensor," IEEE Sensors Journal, Apr. 2002, pp. 82-88, vol. 2, No. 2, IEEE.

Ong, K. G., et al., "Design and application of a wireless, passive, resonant-circuit environmental monitoring sensor," Sensors and Actuators A, 2001, pp. 33-43, vol. 93, Elsevier Science B.V.

Ravi, Kris, et al., "Cementing process optimized to achieve zonal isolation," Petrotech, 2007, 6 pages, Halliburton.

Foreign communication from a related counterpart application—International Search Report and Written Opinion, PCT/GB2010001580, Apr. 21, 2011, 10 pages.

Foreign communication from a related counterpart application—International Search Report and Written Opinion, PCT/GB2010001590, Apr. 21, 2011, 10 pages.

Foreign communication from a related counterpart application—International Search Report and Written Opinion, PCT/GB2010002089, Apr. 21, 2011, 10 pages.

Foreign communication from a related counterpart application—European Search Report, European patent application No. 11159483.4, May 5, 2011, 4 pages.

Foreign communication from a related counterpart application—European Search Report, European patent application No. 11159484.2, May 6, 2011, 4 pages.

Foreign communication from a related counterpart application—European Patent Office communication, European patent application No. 08718914.8, May 31, 2011, 4 pages.

Foreign communication from a related counterpart application—European Search Report, European patent application No. 12167946.8, Jul. 6, 2012, 6 pages.

Foreign communication from a related counterpart application—Notification of European Publication Number and Information on the Application of Article 67(3) EPC, European patent application No. 12167947.6, Jul. 25, 2012, 2 pages.

Foreign communication from a related counterpart application—Communication Pursuant to Rule 69 EPC, European patent application No. 12167947.6, Aug. 27, 2012, 2 pages.

Foreign communication from a related counterpart application—Supplementary European Search Report, European patent application No. 12167947.6, Jul. 6, 2012, 6 pages.

Foreign communication from a related counterpart application—European Patent Office communication, European patent application No. 11159483.4, Jul. 16, 2012, 4 pages.

Notice of Allowance dated Oct. 9, 2012 (6 pages), U.S. Appl. No. 12/618,067, filed Nov. 13, 2009.

Notice of Allowance dated Nov. 19, 2012 (10 pages), U.S. Appl. No. 12/618,067, filed Nov. 13, 2009.

Office Action dated Mar. 9, 2012 (26 pages), U.S. Appl. No. 12/618,067, filed Nov. 13, 2009.

Office Action (Final) dated Aug. 15, 2012 (8 pages), U.S. Appl. No. 12/618,067, filed Nov. 13, 2009.

(56) References Cited

OTHER PUBLICATIONS

Office Action dated Jan. 15, 2014 (90 pages), U.S. Appl. No. 13/031,515, filed Feb. 21, 2011.
Filing receipt and specification for International application entitled "Use of Sensors Coated with Elastomer for Subterranean Operations," filed Sep. 25, 2013 as International application No. PCT/US2013/061611.
Foreign communication from a related counterpart application—Examination Report, European Patent Application No. 11159483.4, Sep. 13, 2013, 4 pages.
Foreign communication from a related counterpart application—Examination Report, European Patent Application No. 12167946.8, Sep. 20, 2013, 4 pages.
Foreign communication from a related counterpart application—International Preliminary Report on Patentability, PCT/GB2008/001084, Oct. 6, 2009, 7 pages.
Foreign communication from a related counterpart application—International Preliminary Report on Patentability, PCT/GB2010/001580, Feb. 28, 2012, 6 pages.
Foreign communication from a related counterpart application—International Preliminary Report on Patentability, PCT/GB2010/001590, Feb. 28, 2012, 6 pages.
Foreign communication from a related counterpart application—International Preliminary Report on Patentability, PCT/GB2010/002089, May 15, 2012, 6 pages.
Filing receipt and specification for patent application entitled "Surface Wellbore Operating Equipment Utilizing MEMS Sensors," by Craig W. Roddy, et al., filed Apr. 2, 2013 as U.S. Appl. No. 13/855,463.
International Preliminary Report on Patentability and Written Opinion issued in related PCT Application No. PCT/US2013/061611, mailed on May 14, 2015 (7 pages).

* cited by examiner

USE OF SENSORS COATED WITH ELASTOMER FOR SUBTERRANEAN OPERATIONS

CROSS-REFERENCE TO RELATED APPLICATIONS

This is a Continuation-in-Part Application of U.S. patent application Ser. No. 12/618,067, filed Nov. 13, 2009, published as US 2010/0051266 A1, and entitled "Use of Micro-Electro-Mechanical Systems (MEMS) in Well Treatments," which is a Continuation-in-Part Application of U.S. patent application Ser. No. 11/695,329 filed Apr. 2, 2007, now U.S. Pat. No. 7,712,527 issued May 11, 2010, and entitled "Use of Micro-Electro-Mechanical Systems (MEMS) in Well Treatments," each of which is hereby incorporated by reference herein in its entirety.

BACKGROUND OF THE INVENTION

This disclosure relates to the field of drilling, completing, servicing, and treating a subterranean well such as a hydrocarbon recovery well. In particular, the present disclosure relates to methods for detecting and/or monitoring the position and/or condition of wellbore servicing compositions, for example wellbore sealants such as cement, using data sensors (for example, MEMS-based sensors) coated with an elastomer. Still more particularly, the present disclosure describes methods of monitoring the integrity and performance of wellbore servicing compositions over the life of the well using data sensors (for example, MEMS-based sensors) coated with an elastomer.

Natural resources such as gas, oil, and water residing in a subterranean formation or zone are usually recovered by drilling a wellbore into the subterranean formation while circulating a drilling fluid in the wellbore. After terminating the circulation of the drilling fluid, a string of pipe (e.g., casing) is run in the wellbore. The drilling fluid is then usually circulated downward through the interior of the pipe and upward through the annulus, which is located between the exterior of the pipe and the walls of the wellbore. Next, primary cementing is typically performed whereby a cement slurry is placed in the annulus and permitted to set into a hard mass (i.e., sheath) to thereby attach the string of pipe to the walls of the wellbore and seal the annulus. Subsequent secondary cementing operations may also be performed. One example of a secondary cementing operation is squeeze cementing whereby a cement slurry is employed to plug and seal off undesirable flow passages in the cement sheath and/or the casing. Non-cementitious sealants are also utilized in preparing a wellbore. For example, polymer, resin, or latex-based sealants may be desirable for placement behind casing.

To enhance the life of the well and minimize costs, sealant slurries are chosen based on calculated stresses and characteristics of the formation to be serviced. Suitable sealants are selected based on the conditions that are expected to be encountered during the sealant service life. Once a sealant is chosen, it is desirable to monitor and/or evaluate the health of the sealant so that timely maintenance can be performed and the service life maximized. The integrity of sealant can be adversely affected by conditions in the well. For example, cracks in cement may allow water influx while acid conditions may degrade cement. The initial strength and the service life of cement can be significantly affected by its moisture content from the time that it is placed. Moisture and temperature are the primary drivers for the hydration of many cements and are critical factors in the most prevalent deteriorative processes, including damage due to freezing and thawing, alkali-aggregate reaction, sulfate attack and delayed Ettringite (hexacalcium aluminate trisulfate) formation. Thus, it is desirable to measure one or more sealant parameters (e.g., moisture content, temperature, pH and ion concentration) in order to monitor sealant integrity.

Active, embeddable sensors can involve drawbacks that make them undesirable for use in a wellbore environment. For example, low-powered (e.g., nanowatt) electronic moisture sensors are available, but have inherent limitations when embedded within cement. The highly alkali environment can damage their electronics, and they are sensitive to electromagnetic noise. Additionally, power must be provided from an internal battery to activate the sensor and transmit data, which increases sensor size and decreases useful life of the sensor. Accordingly, an ongoing need exists for improved methods of monitoring wellbore servicing compositions, for example a sealant condition, from placement through the service lifetime of the composition.

SUMMARY OF SOME OF THE EMBODIMENTS

Disclosed herein is a method comprising placing a wellbore servicing composition comprising a Micro-Electro-Mechanical System (MEMS) sensor in a wellbore and/or subterranean formation, wherein the sensor is coated with an elastomer. The elastomer-coated sensor is configured and operable to detect one or more parameters, including a compression or swelling of the elastomer, an expansion of the elastomer, or a change in density of the composition.

Also disclosed herein is a method comprising placing a Micro-Electro-Mechanical System (MEMS) sensor in a wellbore and/or subterranean formation, placing a wellbore servicing composition in the wellbore and/or subterranean formation, and using the MEMS sensor to detect a location of the wellbore servicing composition, wherein the sensor is coated with an elastomer.

Also disclosed herein is a method comprising placing a Micro-Electro-Mechanical System (MEMS) sensor in a wellbore and/or subterranean formation, placing a wellbore servicing composition in the wellbore and/or subterranean formation, and using the MEMS sensor to monitor a condition of the wellbore servicing composition, wherein the sensor is coated with an elastomer.

Further disclosed herein is a method comprising placing one or more Micro-Electro-Mechanical System (MEMS) sensors in a wellbore and/or subterranean formation, placing a wellbore servicing composition in the subterranean formation, using the one or more MEMS sensors to detect a location of at least a portion of the wellbore servicing composition, and using the one or more MEMS sensors to monitor at least a portion of the wellbore servicing composition, wherein the one or more sensors are coated with an elastomer.

Further disclosed herein is a method comprising placing one or more Micro-Electro-Mechanical System (MEMS) sensors in a wellbore and/or subterranean formation using a wellbore servicing composition, and monitoring a condition using the one or more MEMS sensors, wherein the one or more sensors are coated with an elastomer.

Further disclosed herein is a method comprising placing one or more Micro-Electro-Mechanical System (MEMS) sensors in a wellbore and/or subterranean formation using a wellbore servicing composition, wherein the one or more MEMS sensors comprise an amount from about 0.001 to about 10 weight percent of the wellbore servicing composition, wherein the one or more sensors are coated with an elastomer.

Further disclosed herein is a method comprising placing one or more Micro-Electro-Mechanical System (MEMS) sensors in $CO_2$ injection, storage or disposal well in a subterranean formation, and monitoring a condition using the one or more MEMS sensors, wherein the one or more sensors are coated with an elastomer.

Further disclosed herein is a method comprising placing a wellbore servicing composition comprising a plurality of elastomer-coated sensors in a wellbore, a subterranean formation, or both.

Further disclosed herein is a wellbore servicing composition comprising a base fluid a plurality of elastomer-coated sensors.

The foregoing has outlined rather broadly the features and technical advantages of the present disclosure in order that the detailed description that follows may be better understood. Additional features and advantages of the apparatus and method will be described hereinafter that form the subject of the claims of this disclosure. It should be appreciated by those skilled in the art that the conception and the specific embodiments disclosed may be readily utilized as a basis for modifying or designing other structures for carrying out the same purposes of the present disclosure. It should also be realized by those skilled in the art that such equivalent constructions do not depart from the spirit and scope of the apparatus and method as set forth in the appended claims.

BRIEF DESCRIPTION OF THE DRAWINGS

For a detailed description of the disclosed embodiments of the present disclosure, reference will now be made to the accompanying drawing in which.

DETAILED DESCRIPTION

Figure 1:
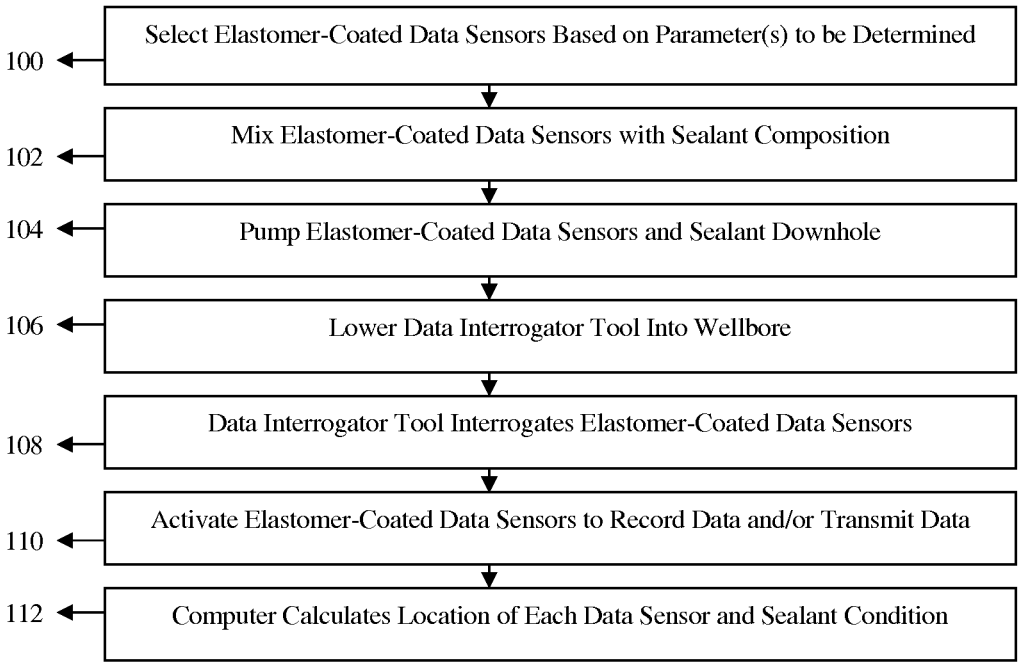
FIG. 1 is a flowchart illustrating an embodiment of a method in accordance with the present disclosure.

Disclosed herein are wellbore servicing compositions (also referred to as wellbore compositions, servicing compositions, wellbore servicing fluids, wellbore fluids, servicing fluids, and the like) comprising one or more sensors coated with an elastomer and methods for utilizing the compositions. As used herein, "elastomer" includes any material or combination of materials which has a tendency to deform and/or compress under an applied force and a further tendency to re-form and/or expand upon removal of the applied force, without substantial adverse effect to the structure of the material. As used herein, "wellbore servicing composition" includes any composition that may be prepared or otherwise provided at the surface and placed down the wellbore, typically by pumping. As used herein, a "sealant" refers to a fluid used to secure components within a wellbore or to plug or seal a void space within the wellbore. Sealants, and in particular cement slurries and non-cementitious compositions, are used as wellbore compositions in several embodiments described herein, and it is to be understood that the methods described herein are applicable for use with other wellbore compositions and/or servicing operation. The wellbore servicing compositions disclosed herein may be used to drill, complete, work over, fracture, repair, treat, or in any way prepare or service a wellbore for the recovery of materials residing in a subterranean formation penetrated by the wellbore. Examples of wellbore servicing compositions include, but are not limited to, cement slurries, non-cementitious sealants, drilling fluids or muds, spacer fluids, fracturing fluids, base fluids of variable-density fluids, or completion fluids. The wellbore servicing compositions are for use in a wellbore that penetrates a subterranean formation, and it will be understood that a wellbore servicing composition that is pumped downhole may be placed in the wellbore, the surrounding subterranean formation, or both as will be apparent in the context of a given servicing operation. It is to be understood that "subterranean formation" encompasses both areas below exposed earth and areas below earth covered by water such as ocean or fresh water. The wellbore may be a substantially vertical wellbore and/or may contain one or more lateral wellbores, for example as produced via directional drilling. As used herein, components are referred to as being "integrated" if they are formed on a common support structure placed in packaging of relatively small size, or otherwise assembled in close proximity to one another.

Embodiments of methods include detecting and/or monitoring the position and/or condition of wellbore servicing compositions and/or the wellbore/surrounding formation using data sensors (e.g., MEMS sensors) which are coated with an elastomer (also referred to herein as "elastomer-coated sensors"). Also disclosed herein are methods of monitoring the integrity and performance of the wellbore servicing compositions, for example during a given wellbore servicing operation and/or over the life of a well, using elastomer-coated sensors (e.g., elastomer-coated MEMS sensors). Performance may be indicated by changes, for example, in various parameters, including, but not limited to, expansion or swelling of the elastomer, compression of the elastomer, and moisture content, pressure, density, temperature, pH, and various ion concentrations (e.g., sodium, chloride, and potassium ions) of the composition.

In embodiments, the methods may comprise the use of elastomer-coated embeddable data sensors (e.g., elastomer-coated MEMS sensors embedded in a wellbore servicing composition) capable of detecting parameters in a wellbore servicing composition, for example a sealant such as cement. In embodiments, the methods provide for evaluation of a sealant during mixing, placement, and/or curing of the sealant within the wellbore. In another embodiment, the method is used for sealant evaluation from placement and curing throughout its useful service life, and where applicable, to a period of deterioration and repair. In embodiments, the methods of this disclosure may be used to prolong the service life of the sealant, lower costs, and enhance creation of improved methods of remediation. Additionally, methods are disclosed for determining the location of sealant within a wellbore, such as for determining the location of a cement slurry during primary cementing of a wellbore as discussed further hereinbelow. Additionally, methods are disclosed for detecting a structural feature such as crack in the composition, e.g., a sealant such as cement, as discussed further hereinbelow.

Discussion of an embodiment of the method of the present disclosure will now be made with reference to the flowchart of FIG. 1, which includes methods of placing a wellbore servicing composition comprising one or more sensors coated with an elastomer in a subterranean formation. The elastomer-coated sensors may generally be used to gather various types of data or information as described herein. At block 100, elastomer-coated data sensors are selected based on the parameter(s) or other conditions to be determined or sensed within the subterranean formation. At block 102, a quantity of elastomer-coated data sensors is mixed with a wellbore servicing composition, for example a sealant slurry. In embodiments, data sensors coated with elastomer are added to the wellbore servicing composition (e.g., a sealant) by any methods known to those of skill in the art. For example, for a wellbore servicing composition formulated as a sealant (e.g., a cement slurry), the elastomer-coated sensors may be mixed with a dry material, mixed with one more liquid components (e.g., water or a non-aqueous fluid), or combinations thereof. The mixing may occur onsite, for example addition of the sensors into a bulk mixer such as a cement slurry mixer. The elastomer-coated sensors may be added directly to the mixer, may be added to one or more component streams and subsequently fed to the mixer, may be added downstream of the mixer, or combinations thereof. In embodiments, elastomer-coated data sensors are added after a blending unit and slurry pump, for example, through a lateral by-pass. The elastomer-coated sensors may be metered in and mixed at the well site, or may be pre-mixed into the wellbore servicing composition (or one or more components thereof) and subsequently transported to the well site. For example, the sensors may be dry mixed with dry cement and transported to the well site where a cement slurry is formed comprising the sensors. Alternatively or additionally, the sensors may be pre-mixed with one or more liquid components (e.g., mix water) and transported to the well site where a cement slurry is formed comprising the sensors. The properties of the wellbore composition or components thereof may be such that the sensors distributed or dispersed therein do not substantially settle or stratify during transport or placement.

The wellbore servicing composition (e.g., a sealant slurry and elastomer-coated sensors) is then pumped downhole at block 104, whereby the sensors are positioned or placed within the wellbore. For example, the sensors may extend along all or a portion of the length of the wellbore (e.g., in an annular space adjacent casing) and/or into the surrounding formation (e.g., via a fissure or fracture). The composition may be placed downhole as part of a primary cementing, secondary cementing, or other sealant operation as described in more detail herein. At block 106, a data interrogator tool is positioned in an operable location to gather data from the elastomer-coated sensors, for example lowered within the wellbore proximate the sensors. At block 108, the data interrogator tool interrogates the elastomer-coated sensors (e.g., by sending out an RF signal) while the data interrogator tool traverses all or a portion of the wellbore containing the sensors. The elastomer-coated data sensors are activated to record and/or transmit data at block 110 via the signal from the data interrogator tool. At block 112, the data interrogator tool communicates the data to one or more computer components (e.g., memory and/or microprocessor) that may be located within the tool, at the surface, or both. The data may be used locally or remotely from the tool to calculate the location of each elastomer-coated data sensor and correlate the measured parameter(s) to such locations to evaluate performance of the wellbore servicing composition (e.g., sealant).

Data gathering, as shown in blocks 106 to 112 of FIG. 1, may be carried out at the time of initial placement in the well of the servicing composition comprising elastomer-coated sensors, for example during drilling (e.g., a composition comprising drilling fluid and elastomer-coated MEMS sensors) or during cementing (e.g., a composition comprising a cement slurry and elastomer-coated MEMS sensors) as described in more detail below. Additionally or alternatively, data gathering may be carried out at one or more times subsequent to the initial placement in the well of the composition comprising elastomer-coated sensors. For example, data gathering may be carried out at the time of initial placement in the well of the composition comprising elastomer-coated sensors or shortly thereafter to provide a baseline data set. As the well is operated for recovery of natural resources over a period of time, data gathering may be performed additional times, for example at regular maintenance intervals such as every 1 year, 5 years, or 10 years. The data recovered during subsequent monitoring intervals can be compared to the baseline data as well as any other data obtained from previous monitoring intervals, and such comparisons may indicate the overall condition of the wellbore. For example, changes in one or more sensed parameters may indicate one or more problems in the wellbore and/or surrounding formation. Alternatively, consistency or uniformity in sensed parameters may indicate no substantive problems in the wellbore and/or surrounding formation. In an embodiment, data (e.g., sealant parameters) from a plurality of monitoring intervals is plotted over a period of time, and a resultant graph is provided showing an operating or trend line for the sensed parameters. Atypical changes in the graph as indicated for example by a sharp change in slope or a step change on the graph may provide an indication of one or more present problems or the potential for a future problem. Accordingly, remedial and/or preventive treatments or services may be applied to the wellbore to address present or potential problems.

In embodiments, the wellbore servicing composition may be formulated as a sealant (e.g., a cementitious slurry) comprising elastomer-coated sensors. The sealant may comprise any wellbore sealant known in the art. Examples of sealants include cementitious and non-cementitious sealants both of which are well known in the art. In embodiments, non-cementitious sealants comprise resin based systems, latex based systems, or combinations thereof. In embodiments, the sealant comprises a cement slurry with styrene-butadiene latex (e.g., as disclosed in U.S. Pat. No. 5,588,488 incorporated by reference herein in its entirety). Sealants may be utilized in setting expandable casing, which is further described hereinbelow. In other embodiments, the sealant is a cement utilized for primary or secondary wellbore cementing operations, as discussed further hereinbelow.

The sealant may include a sufficient amount of water to form a pumpable slurry. The water may be fresh water or salt water (e.g., an unsaturated aqueous salt solution or a saturated aqueous salt solution such as brine or seawater). In embodiments, the cement slurry may be a lightweight cement slurry containing foam (e.g., foamed cement) and/or hollow beads/microspheres. In an embodiment, elastomer-coated MEMS sensors are incorporated into or attached to all or a portion of the hollow microspheres. Additionally or alternatively, the elastomer-coated sensors may be dispersed within the cement along with the microspheres. Examples of sealants containing microspheres are disclosed in U.S. Pat. Nos. 4,234,344; 6,457,524; and 7,174,962, each of which is incorporated herein by reference in its entirety. In an embodiment, the elastomer-coated sensors are incorporated into a foamed cement such as those described in more detail in U.S. Pat. Nos. 6,063,738; 6,367,550; 6,547,871; and 7,174,962, each of which is incorporated by reference herein in its entirety.

In some embodiments, additives may be included in the sealant for improving or changing the properties thereof. Examples of such additives include but are not limited to accelerators, set retarders, defoamers, fluid loss agents, weighting materials, dispersants, density-reducing agents, formation conditioning agents, lost circulation materials, thixotropic agents, suspension aids, or combinations thereof.

Other mechanical property modifying additives, for example, fibers, polymers, resins, latexes, and the like can be added to further modify the mechanical properties. These additives may be included singularly or in combination. Methods for introducing these additives and their effective amounts are known to one of ordinary skill in the art.

In embodiments, the sealant and elastomer-coated sensors may be placed substantially within the annular space between a casing and the wellbore wall. That is, substantially all of the elastomer-coated sensors are located within or in close proximity to the annular space. In an embodiment, the wellbore servicing fluid comprising the elastomer-coated sensors does not substantially penetrate, migrate, or travel into the formation from the wellbore. In an alternative embodiment, substantially all of the elastomer-coated sensors are located within, adjacent to, or in close proximity to the wellbore, for example less than or equal to about 1 foot, 3 feet, 5 feet, or 10 feet from the wellbore. Such adjacent or close proximity positioning of the sensors with respect to the wellbore is in contrast to placing sensors in a fluid that is pumped into the formation in large volumes and substantially penetrates, migrates, or travels into or through the formation, for example as occurs with a fracturing fluid or a flooding fluid. Thus, in embodiments, the elastomer-coated sensors are placed proximate or adjacent to the wellbore (in contrast to the formation at large), and provide information relevant to the wellbore itself and compositions (e.g., sealants) used therein (again in contrast to the formation or a producing zone at large).

In embodiments, the sealant comprising elastomer-coated sensors may be allowed to set (e.g., in the annulus described above, in a subterranean formation, etc.). For example, the sealant may be cementitious and may comprise a hydraulic cement that sets and hardens by reaction with water. Examples of hydraulic cements include but are not limited to Portland cements (e.g., classes A, B, C, G, and H Portland cements), pozzolana cements, gypsum cements, phosphate cements, high alumina content cements, silica cements, high alkalinity cements, shale cements, acid/base cements, magnesia cements, fly ash cement, zeolite cement systems, cement kiln dust cement systems, slag cements, micro-fine cement, metakaolin, and combinations thereof. Examples of sealants are disclosed in U.S. Pat. Nos. 6,457,524; 7,077,203; and 7,174,962, each of which is incorporated herein by reference in its entirety. In an embodiment, the sealant comprises a sorel cement composition, which typically comprises magnesium oxide and a chloride or phosphate salt which together form for example magnesium oxychloride. Examples of magnesium oxychloride sealants are disclosed in U.S. Pat. Nos. 6,664,215 and 7,044,222, each of which is incorporated herein by reference in its entirety.

In additional or alternative embodiments, the wellbore servicing composition may be formulated as a drilling fluid comprising elastomer-coated sensors. Various types of drilling fluids, also known as muds or drill-in fluids have been used in well drilling, such as water-based fluids, oil-based fluids (e.g., mineral oil, hydrocarbons, synthetic oils, esters, etc.), gaseous fluids, or a combination thereof. Drilling fluids typically contain suspended solids. Drilling fluids may form a thin, slick filter cake on the formation face that provides for successful drilling of the wellbore and helps prevent loss of fluid to the subterranean formation. In an embodiment, at least a portion of the elastomer-coated sensors remain associated with the filtercake (e.g., disposed therein) and may provide information as to a condition (e.g., thickness) and/or location of the filtercake. Additionally or in the alternative, at least a portion of the elastomer-coated sensors remain associated with drilling fluid and may provide information as to a condition and/or location of the drilling fluid.

In additional or alternative embodiments, the wellbore servicing composition may be formulated as a fracturing fluid comprising elastomer-coated sensors. Generally, a fracturing fluid comprises a fluid or mixture of fluids that when placed downhole under suitable conditions, induces fractures within the subterranean formation. Hydrocarbon-producing wells often are stimulated by hydraulic fracturing operations, wherein a fracturing fluid may be introduced into a portion of a subterranean formation penetrated by a wellbore at a hydraulic pressure sufficient to create, enhance, and/or extend at least one fracture therein. Stimulating or treating the wellbore in such ways increases hydrocarbon production from the well. In some embodiments, the elastomer-coated sensors may be contained within a wellbore servicing composition that when placed downhole enters and/or resides within one or more fractures within the subterranean formation. In such embodiments, the elastomer-coated sensors provide information as to the location and/or condition of the fluid and/or fracture during and/or after treatment. In an embodiment, at least a portion of the elastomer-coated sensors remain associated with a fracturing fluid and may provide information as to the condition and/or location of the fluid. Fracturing fluids often contain proppants that are deposited within the formation upon placement of the fracturing fluid therein, and in an embodiment a fracturing fluid contains one or more proppants and one or more elastomer-coated sensors. In an embodiment, at least a portion of the elastomer-coated sensors remain associated with the proppants deposited within the formation (e.g., a proppant bed) and may provide information as to the condition (e.g., thickness, density, settling, stratification, integrity, etc.) and/or location of the proppants. Additionally or in the alternative at least a portion of the elastomer-coated sensors remain associated with a fracture (e.g., adhere to and/or retained by a surface of a fracture) and may provide information as to the condition (e.g., length, volume, etc.) and/or location of the fracture. For example, the elastomer-coated sensors may provide information useful for ascertaining the fracture complexity.

In additional or alternative embodiments, the wellbore servicing composition may be formulated as a gravel pack fluid comprising elastomer-coated sensors. Gravel pack fluids may be employed in a gravel packing treatment. The elastomer-coated sensors may provide information as to the condition and/or location of the composition during and/or after the gravel packing treatment. Gravel packing treatments are used, inter alia, to reduce the migration of unconsolidated formation particulates into the wellbore. In gravel packing operations, particulates, referred to as gravel, are carried to a wellbore in a subterranean producing zone by a servicing fluid known as carrier fluid. That is, the particulates are suspended in a carrier fluid, which may be viscosified, and the carrier fluid is pumped into a wellbore in which the gravel pack is to be placed. As the particulates are placed in the zone, the carrier fluid leaks off into the subterranean zone and/or is returned to the surface. The resultant gravel pack acts as a filter to separate formation solids from produced fluids while permitting the produced fluids to flow into and through the wellbore. When installing the gravel pack, the gravel is carried to the formation in the form of a slurry by mixing the gravel with a viscosified carrier fluid. Such gravel packs may be used to stabilize a formation while causing minimal impairment to well productivity. The gravel, inter alia, acts to prevent the particulates from occluding the screen or migrating with the produced fluids, and the screen, inter alia, acts to prevent the gravel from entering the wellbore. In an embodiment, the wellbore servicing composition (e.g., gravel pack fluid) comprises a carrier fluid, gravel and one or more elastomer coated MEMS sensors. In an embodiment, at least a portion of the elastomer-coated sensors remains associated with the gravel deposited within the wellbore and/or subterranean formation (e.g., a gravel pack/bed) after removal of the carrier fluid and may provide information as to the condition (e.g., thickness, density, settling, stratification, integrity, etc.) and/or location of the gravel pack/bed.

In additional or alternative embodiments, the wellbore servicing composition may be formulated as a spacer fluid comprising elastomer-coated sensors. Spacer fluids may be used to separate two other fluids (e.g., two other wellbore servicing fluids) from one another, due to a specialized purpose for the separated fluids, a possibility of contamination, incompatibility (e.g., chemically), or combinations thereof. For example, a spacer fluid (e.g., an aqueous fluid such as water) may be used to separate a sealant and a drilling fluid in the wellbore during cementing operations. In embodiments, the elastomer-coated sensors may provide information regarding the location, position, integrity, flow, etc. of the spacer fluid.

In additional or alternative embodiments, the wellbore servicing composition may be formulated as a completion fluid comprising elastomer-coated sensors. Completion fluids may be used to prevent damage to a well upon completion, and for example may comprise brines such as formates, chlorides, or bromides. In embodiments, the elastomer-coated sensors may provide information regarding the location, position, of the completion fluid, and additionally or alternatively, the integrity of the completed well over the life of the well.

In additional or alternative embodiments, the wellbore servicing composition may comprise a base fluid (e.g., an aqueous fluid, oleaginous fluid, or both) and one or more elastomer-coated sensors. In such embodiments, the wellbore servicing composition may be referred to as a variable-density fluid. The density of the variable-density fluid may vary as a function of pressure. For example, the variable-density fluid may encounter higher pressures (e.g., as the wellbore servicing composition is placed downhole) than at a previous pressure (e.g., the pressure at sea level), and the elastomer coatings compress against the sensors and decrease the volume of the elastomer coating of the sensors, and thus, of the elastomer-coated sensors. The decrease in volume of the elastomer-coated sensors increases the density of the variable-density fluid. In embodiments, the density of the variable-density fluid may increase from 0.1% to 300% of the density of the variable-density fluid at earth or sea level. Likewise, the variable-density fluid may encounter lower pressures (e.g., as the wellbore servicing composition is moved upward through the wellbore, into a low pressure environment in the subterranean formation, or combinations thereof) than at a previous pressure (e.g., a downhole pressure, a pressure of a subterranean formation, or combinations thereof), and the elastomer coatings expand and increase the volume of the elastomer-coated sensors. The increase in volume of the elastomer-coated sensors decreases the density of the variable-density fluid.

In embodiments, the variable density fluid may vary in density at particular phases of a subterranean operation (e.g., drilling, fracturing, or the like) as may be necessary to adapt to the subterranean conditions to which the fluid is subjected. For example, where the variable density fluid is utilized in offshore drilling applications, the variable density fluid may have a lower density when located above the ocean floor, and subsequently have a higher density when located within the well bore beneath the ocean floor. Generally, the variable density fluid may have a density in the range of about 4 lb/gallon to about 18 lb/gallon when measured at sea level. When utilized in offshore applications, the variable density fluids may have a density in the range of about 6 lb/gallon to about 20 lb/gallon, measured when at a point of maximum compression.

In embodiments, the base fluid of the variable density fluid may comprise an aqueous-based fluid, a non-aqueous-based fluid, or mixtures thereof. When aqueous-based, the water utilized can be fresh water, salt water (e.g., water containing one or more salts dissolved therein), brine (e.g., saturated salt water), seawater, or combinations thereof. Generally, the water can be from any source provided that it does not contain an excess of compounds that may adversely affect other components in the variable density fluid. When non-aqueous-based, the base fluid may comprise any number of organic fluids. Examples of suitable organic fluids may include mineral oils; synthetic oils; esters; hydrocarbons; oil; diesel; naturally occurring oils such as vegetable, plant, seed, or nut oils; the like; or combinations thereof. Generally, any oil in which a water solution of salts can be emulsified (or vice-versa) may be suitable for use in a variable-density fluid. Generally, the base fluid may be present in an amount sufficient to form a pumpable wellbore composition (e.g., a variable density fluid). For example, the base fluid is typically present in the disclosed composition in an amount in the range of about 20% to about 99.99% by volume of the composition.

In one or more embodiments, the elastomer (i.e., the elastomer which coats the sensors) may comprise any material or combination of materials which has a tendency to deform and/or compress under an applied force and a further tendency to re-form and/or expand upon removal of the applied force, without substantial adverse effect to the structure of the material. In additional or alternative embodiments, the elastomer may comprise any material or combination of materials which may swell when in contact with a certain fluid (e.g., a hydrocarbon or water), when subject to a temperature which causes swelling, when subject to a pressure which causes swelling, when subject to a particular pH, or combinations thereof. Suitable elastomers may comprise a specific gravity relative to water in the range of about 0.05 to about 2.00; alternatively, in the range of about 0.05 to about 0.99; alternatively, in the range of about 1.00 to about 2.00. In embodiments, the elastomer may be shear resistant, fatigue resistant, substantially impermeable to fluids typically encountered in subterranean formations, or combinations thereof. In embodiments, the elastomer may comprise an isothermal compressibility factor in the range of about $1.5\times10^{-3}$ (1/psi) to about $1.5\times10^{-9}$ (1/psi), where "isothermal compressibility factor" is defined as a change in volume with pressure, per unit volume of the elastomer, at a constant temperature. In embodiments, the elastomer may be suitable for use in temperatures up to about 500° F. without degrading. In additional or alternative embodiments, the elastomer coating may be suitable for use in pressures up to about 21,000 psi without crushing the sensors (e.g., MEMS sensors).

Suitable elastomers may comprise a polymer and/or copolymer that, at a given temperature and pressure, changes volume by expansion and compression, and consequently, may change the density of the wellbore composition (e.g., variable density fluid). In embodiments, the elastomer may comprise a copolymer of styrene and divinylbenzene; a copolymer of methylmethacrylate and acrylonitrile; a copolymer of styrene and acrylonitrile; a terpolymer of methylmethacrylate, acrylonitrile, and vinylidene dichloride; a terpolymer of styrene, vinylidene chloride, and acrylonitrile; a phenolic resin; polystyrene; or combinations thereof. Examples of suitable elastomers are disclosed in U.S. Pat. No.

7,749,942, which is incorporated herein in its entirety. In additional or alternative embodiments, the elastomer may comprise a WellLife® material, which is an elastomeric material commercially available from Halliburton.

Suitable elastomers, such as those described above, can be chosen according to the ability to withstand the temperatures and pressures associated with pumping and/or circulating through an annulus of a wellbore around a casing, into a subterranean formation, through a drill bit, or combinations thereof. Additionally or alternatively, suitable elastomers can be chosen according to the ability to withstand the temperatures and pressures associated with curing and setting of cements in a wellbore and/or subterranean formation. In embodiments where the composition is moved through wellbore equipment or a subterranean formation, the elastomer may resist adhering to the wellbore equipment (e.g., drill pipe, the drill bit) or the subterranean formation.

In embodiments, the sensors are coated with an elastomer by methods recognized by those skilled in the art with the aid of this disclosure. For example, the sensors may be dipped in a liquid comprising the elastomer which then forms an elastomer coating upon drying. Alternatively, the elastomer may be melted and the sensors mixed and distributed into a molten elastomer (e.g., via compounding and/or extruding) and subsequently pelletized. Alternatively, the elastomer may be spray coated upon the sensors. Alternatively, the elastomer may be formed (e.g., polymerized) in the presence of the sensors. For example, the sensors (e.g., MEMS sensors) may be fluidized in a gas phase polymerization process wherein the sensors are coated as reactants polymerize to form the elastomer coating. In an embodiment, the sensors are coated in combination with one or more additional particulate materials to be employed in a given wellbore servicing composition. For example, particulate material (e.g., sand, gravel, etc.) and sensors (e.g., MEMS sensors) could be mixed and then subjected to a coating process of the type described herein to yield an elastomer coated particulate mixture comprising elastomer-coated sensors (e.g., a elastomer-coated proppant material comprising sensors, and elastomer-coated gravel pack material comprising sensors, etc.). In embodiments, the thickness of the elastomer coating on the sensors may range from about 0.0001 mm to 10 mm; 0.0001 to 1 mm; 0.0001 to 0.1 mm; 0.001 to 10 mm; 0.001 to 1 mm; 0.001 to 0.1 mm; or any suitable range within these endpoints.

In embodiments, the sensors contained within the elastomer coatings may be silicon-based and/or non-silicon based. Silicon-based sensors utilize silicon, for example, as a substrate for the sensor. Non-silicon based sensors may include liquid crystal display (LCD) sensors, conductive polymer sensors, bio-polymer sensors, or combinations thereof. In embodiments, the sensors may comprise a polymer diode which provides data at low frequencies, which enables the sensors to provide information through thicker mediums (e.g., the compositions disclosed herein, a subterranean formation, casing, a drill string, or combinations thereof) than would otherwise be possible at frequencies above the low frequencies of the polymer diode. Suitable sensors are disclosed in U.S. Pat. No. 7,832,263, which is incorporated herein by reference in its entirety.

In additional or alternative embodiments, the sensors contained within the elastomer coatings may comprise microelectromechanical systems (MEMS) comprising one or more (and typically a plurality of) MEMS devices, referred to herein as MEMS sensors. Suitable MEMS devices may be selected with the aid of this disclosure, e.g., a semiconductor device with mechanical features on the micrometer scale. The MEMS devices disclosed herein may be on the nanometer to micrometer scale. MEMS sensors embody the integration of mechanical elements, sensors, actuators, and electronics on a common substrate such as silicon or non-silicon based substrates. MEMS elements may include mechanical elements which are movable by an input energy (electrical energy or other type of energy). Using MEMS, a sensor may be designed to emit a detectable signal based on a number of physical phenomena, including thermal, biological, optical, chemical, and magnetic effects or stimulation. MEMS devices are minute in size, have low power requirements, are relatively inexpensive and are rugged, and thus are well suited for use in wellbore servicing compositions and related operations.

In embodiments, the elastomer-coated sensors may sense one or more parameters within the wellbore, within a wellbore servicing fluid, within a subterranean formation, or combinations thereof. In embodiments, the one or more parameters may comprise temperature, pH, moisture content, ion concentration (e.g., chloride, sodium, and/or potassium ions), well cement characteristic data (e.g., stress, strain, cracks, voids, gaps, or combinations thereof), expansion of the elastomer, compression of the elastomer, swelling of the elastomer, other parameters disclosed herein, or combinations thereof. In embodiments, the elastomer-coated sensors may sense a change in configuration of the elastomer-coated sensor, for example a change in the deflection, stress, strain, and/or thickness of the elastomer coating (e.g., due to a change in pressure and/or temperature), an activation or deactivation of the sensor (e.g., due to a change in one or more of the parameters described herein), a change in transmission frequency, a change in time between transmissions, or combinations thereof.

In embodiments, the sensors coated with an elastomer (e.g., MEMS sensors, LCD sensors, conductive polymer sensors, bio-polymer sensors, or combinations thereof) may provide information as to a location, flow path/profile, volume, density, temperature, pressure, the presence or absence of a particular fluid (e.g., water, a hydrocarbon), or a combination thereof, for a drilling fluid, a fracturing fluid, a gravel pack fluid, or other wellbore servicing fluid in real time such that the effectiveness of such service may be monitored and/or adjusted during performance of the service to improve the result of same. Accordingly, the elastomer-coated sensors may aid in the initial performance of the wellbore service additionally or alternatively to providing a means for monitoring a wellbore condition or performance of the service over a period of time (e.g., over a servicing interval and/or over the life of the well). For example, the one or more elastomer-coated sensors may be used in monitoring a gas or a liquid produced from the subterranean formation. Elastomer-coated sensors present in the wellbore and/or formation may be used to provide information as to the condition (e.g., temperature, pressure, flow rate, composition, etc.) and/or location of a gas or liquid produced from the subterranean formation. In an embodiment, the elastomer-coated sensors provide information regarding the composition of a produced gas or liquid. For example, the elastomer-coated sensors may be used to monitor an amount of water produced in a hydrocarbon producing well (e.g., amount of water present in hydrocarbon gas or liquid), an amount of undesirable components or contaminants in a produced gas or liquid (e.g., sulfur, carbon dioxide, hydrogen sulfide, etc. present in hydrocarbon gas or liquid), or a combination thereof.

In additional or alternative embodiments, the elastomer-coated sensors may provide information regarding the structural integrity of a wellbore servicing composition (e.g., a composition disclosed herein, such as a sealant comprising a cement) which has set. For example, the elastomer-coated sensors may be used to detect the presence or absence of a fluid (e.g., a hydrocarbon or water) present in compromised areas (e.g., cracks, voids, gaps, chips) of the cement. The elastomer-coated sensors may be used to detect the presence or absence of a gas or liquid. The elastomer coating of a sensor embedded within the composition (e.g., set cement) may expand and/or swell in the presence of the fluid (e.g., hydrocarbon), creating a greater pressure on the sensor which is detected by the sensor. The elastomer coating of a sensor may also retract and release the pressure of swelling or expansion upon removal of the fluid from presence at the elastomer coating of the sensors.

In addition or in the alternative, an elastomer-coated sensor incorporated within one or more of the wellbore servicing compositions disclosed herein may provide information that allows a condition (e.g., thickness, density, volume, settling, stratification, etc.) and/or location of the wellbore servicing composition within the subterranean formation to be detected.

In embodiments, the sensors contained within the elastomer coating are ultra-small, e.g., 3 $mm^2$, such that the elastomer-coated sensors are pumpable in the disclosed wellbore servicing compositions (e.g., a sealant slurry, a variable density fluid, a fracturing mixture, etc.). In embodiments, the MEMS device of the elastomer-coated sensor may be approximately 0.01 $mm^2$ to 1 $mm^2$, alternatively 1 $mm^2$ to 3 $mm^2$, alternatively 3 $mm^2$ to 5 $mm^2$, or alternatively 5 $mm^2$ to 10 $mm^2$. In embodiments, the elastomer-coated sensors may be approximately 0.01 $mm^2$ to 10 $mm^2$. In embodiments, the elastomer-coated data sensors are capable of providing data throughout the service life of the wellbore servicing composition (e.g., a set cement). In embodiments, the elastomer-coated data sensors are capable of providing data for up to 100 years. In an embodiment, the composition comprises an amount of elastomer-coated sensors effective to measure one or more desired parameters. In various embodiments, the wellbore servicing composition comprises an effective amount of elastomer-coated sensors such that sensed readings may be obtained at intervals of about 1 foot, alternatively about 6 inches, or alternatively about 1 inch, along the portion of the wellbore containing the elastomer-coated sensors. In an embodiment, the elastomer-coated sensors may be present in the disclosed wellbore servicing compositions in an amount of from about 0.001 to about 10 weight percent. Alternatively, the elastomer-coated sensors may be present in the disclosed wellbore servicing compositions in an amount of from about 0.01 to about 5 weight percent.

In embodiments, the elastomer-coated sensors added to (e.g., mixed with) the wellbore servicing composition may comprise passive sensors that do not require continuous power from a battery or an external source in order to transmit real-time data. Additionally or alternatively, the elastomer-coated sensors may comprise an active material connected to (e.g., mounted within or mounted on the surface of) an enclosure, the active material being liable to respond to a wellbore parameter, and the active material being operably connected to (e.g., in physical contact with, surrounding, or coating) a capacitive MEMS element. In embodiments, the elastomer-coated sensors of the present disclosure may comprise one or more active materials that respond to two or more the parameters described herein. In such a way, two or more parameters may be monitored.

Suitable active materials, such as dielectric materials, that respond in a predictable and stable manner to changes in parameters over a long period may be identified according to methods well known in the art, for example see, e.g., Ong, Zeng and Grimes. "A Wireless, Passive Carbon Nanotube-based Gas Sensor," IEEE Sensors Journal, 2, 2, (2002) 82-88; Ong, Grimes, Robbins and Singl, "Design and application of a wireless, passive, resonant-circuit environmental monitoring sensor," Sensors and Actuators A, 93 (2001) 33-43, each of which is incorporated by reference herein in its entirety. MEMS sensors suitable for the methods of the present disclosure that respond to various wellbore parameters are disclosed in U.S. Pat. No. 7,038,470 B1 that is incorporated herein by reference in its entirety.

In embodiments, the sensors encased in the elastomer coatings are coupled with radio frequency identification devices (RFIDs) and can thus detect and transmit parameters and/or well cement characteristic data for monitoring the cement during its service life. RFIDs combine a microchip with an antenna (the RFID chip and the antenna are collectively referred to as the "transponder" or the "tag"). The antenna provides the RFID chip with power when exposed to a narrow band, high frequency electromagnetic field from a transceiver. A dipole antenna or a coil, depending on the operating frequency, connected to the RFID chip, powers the transponder when current is induced in the antenna by an RF signal from the transceiver's antenna. Such a device can return a unique identification "ID" number by modulating and re-radiating the radio frequency (RF) wave. Passive RF tags are gaining widespread use due to their low cost, indefinite life, simplicity, efficiency, ability to identify parts at a distance without contact (tether-free information transmission ability). These robust and tiny tags are attractive from an environmental standpoint as they require no battery. The sensor and RFID tag are preferably integrated into a single component (e.g., chip or substrate), or may alternatively be separate components operably coupled to each other. In an embodiment, an integrated, passive MEMS/RFID elastomer-coated sensor contains a data sensing component, an optional memory, and an RFID antenna, whereby excitation energy is received and powers up the sensor, thereby sensing a present condition and/or accessing one or more stored sensed conditions from memory and transmitting same via the RFID antenna.

Within the United States, commonly used operating bands for RFID systems center on one of the three government assigned frequencies: 125 kHz, 13.56 MHz or 2.45 GHz. A fourth frequency, 27.125 MHz, has also been assigned. When the 2.45 GHz carrier frequency is used, the range of an RFID chip can be many meters. While this is useful for remote sensing, there may be multiple transponders within the RF field. In order to prevent these devices from interacting and garbling the data, anti-collision schemes are used, as are known in the art. In embodiments, the data sensors are integrated with local tracking hardware to transmit their position as they flow within a sealant slurry. The data sensors may form a network using wireless links to neighboring data sensors and have location and positioning capability through, for example, local positioning algorithms as are known in the art. The sensors may organize themselves into a network by listening to one another, therefore allowing communication of signals from the farthest sensors towards the sensors closest to the interrogator to allow uninterrupted transmission and capture of data. In such embodiments, the interrogator tool may not need to traverse the entire section of the wellbore containing elastomer-coated sensors in order to read data gathered by such sensors. For example, the interrogator tool may only need to be lowered about half-way along the vertical length of the wellbore containing elastomer-coated sensors. Alternatively, the interrogator tool may be lowered vertically within the wellbore to a location adjacent to a horizontal arm of a well, whereby elastomer-coated sensors located in the horizontal arm may be read without the need for the interrogator tool to traverse the horizontal arm. Alternatively, the interrogator tool may be used at or near the surface and read the data gathered by the sensors distributed along all or a portion of the wellbore. For example, sensors located distal to the interrogator may communicate via a network formed by the sensors as described previously.

In embodiments, the elastomer-coated sensors comprise passive (remain unpowered when not being interrogated) sensors energized by energy radiated from a data interrogator tool. The data interrogator tool may comprise an energy transceiver sending energy (e.g., radio waves) to and receiving signals from the elastomer-coated sensors and a processor processing the received signals. The data interrogator tool may further comprise a memory component, a communications component, or both. The memory component may store raw and/or processed data received from the elastomer-coated sensors, and the communications component may transmit raw data to the processor and/or transmit processed data to another receiver, for example located at the surface. The tool components (e.g., transceiver, processor, memory component, and communications component) are coupled together and in signal communication with each other.

In an embodiment, one or more of the data interrogator components may be integrated into a tool or unit that is temporarily or permanently placed downhole (e.g., a downhole module). In an embodiment, a removable downhole module comprises a transceiver and a memory component, and the downhole module is placed into the wellbore, reads data from the elastomer-coated sensors, stores the data in the memory component, is removed from the wellbore, and the raw data is accessed. Alternatively, the removable downhole module may have a processor to process and store data in the memory component, which is subsequently accessed at the surface when the tool is removed from the wellbore. Alternatively, the removable downhole module may have a communications component to transmit raw data to a processor and/or transmit processed data to another receiver, for example located at the surface. The communications component may communicate via wired or wireless communications. For example, the downhole component may communicate with a component or other node on the surface via a cable or other communications/telemetry device such as a radio frequency, electromagnetic telemetry device or an acoustic telemetry device. The removable downhole component may be intermittently positioned downhole via any suitable conveyance, for example wire-line, coiled tubing, straight tubing, gravity, pumping, etc., to monitor conditions at various times during the life of the well.

In embodiments, the data interrogator tool comprises a permanent or semi-permanent downhole component that remains downhole for extended periods of time. For example, a semi-permanent downhole module may be retrieved and data downloaded once every few years. Alternatively, a permanent downhole module may remain in the well throughout the service life of well. In an embodiment, a permanent or semi-permanent downhole module comprises a transceiver and a memory component, and the downhole module is placed into the wellbore, reads data from the elastomer-coated sensors, optionally stores the data in the memory component, and transmits the read and optionally stored data to the surface. Alternatively, the permanent or semi-permanent downhole module may have a processor to process and sensed data into processed data, which may be stored in memory and/or transmit to the surface. The permanent or semi-permanent downhole module may have a communications component to transmit raw data to a processor and/or transmit processed data to another receiver, for example located at the surface. The communications component may communicate via wired or wireless communications. For example, the downhole component may communicate with a component or other node on the surface via a cable or other communications/telemetry device such as an radio frequency, electromagnetic telemetry device or an acoustic telemetry device.

In embodiments, the data interrogator tool comprises an RF energy source incorporated into its internal circuitry and the data sensors are passively energized using an RF antenna, which picks up energy from the RF energy source. In an embodiment, the data interrogator tool is integrated with an RF transceiver. In embodiments, the elastomer-coated sensors (e.g., MEMS/RFID sensors) are empowered and interrogated by the RF transceiver from a distance, for example a distance of greater than 10 m, or alternatively from the surface or from an adjacent offset well. In an embodiment, the data interrogator tool traverses within a casing in the well and reads elastomer-coated sensors located in a sealant (e.g., cement) sheath surrounding the casing and located in the annular space between the casing and the wellbore wall. In embodiments, the interrogator senses the elastomer-coated sensors when in close proximity with the sensors, typically via traversing a removable downhole component along a length of the wellbore comprising the elastomer-coated sensors. In an embodiment, close proximity comprises a radial distance from a point within the casing to a planar point within an annular space between the casing and the wellbore. In embodiments, close proximity comprises a distance of 0.1 m to 1 m. Alternatively, close proximity comprises a distance of 1 m to 5 m. Alternatively, close proximity comprises a distance of from 5 m to 10 m. In embodiments, the transceiver interrogates the sensor with RF energy at 125 kHz and close proximity comprises 0.1 m to 0.25 m. Alternatively, the transceiver interrogates the sensor with RF energy at 13.5 MHz and close proximity comprises 0.25 m to 0.5 m. Alternatively, the transceiver interrogates the sensor with RF energy at 915 MHz and close proximity comprises 0.5 m to 1 m. Alternatively, the transceiver interrogates the sensor with RF energy at 2.4 GHz and close proximity comprises 1 m to 2 m.

In embodiments, the elastomer-coated sensors are incorporated into wellbore cement and used to collect data during and/or after cementing the wellbore. The data interrogator tool may be positioned downhole during cementing, for example integrated into a component such as casing, casing attachment, plug, cement shoe, or expanding device. Alternatively, the data interrogator tool is positioned downhole upon completion of cementing, for example conveyed downhole via wireline. The cementing methods disclosed herein may optionally comprise the step of foaming the cement composition using a gas such as nitrogen or air. The foamed cement compositions may comprise a foaming surfactant and optionally a foaming stabilizer. The elastomer-coated sensors may be incorporated into a sealant composition and placed downhole, for example during primary cementing (e.g., conventional or reverse circulation cementing), secondary cementing (e.g., squeeze cementing), or other sealing operation (e.g., behind an expandable casing).

In primary cementing, cement is positioned in a wellbore to isolate an adjacent portion of the subterranean formation and provide support to an adjacent conduit (e.g., casing). The cement forms a barrier that prevents fluids (e.g., water or hydrocarbons) in the subterranean formation from migrating into adjacent zones or other subterranean formations. In embodiments, the wellbore in which the cement is positioned belongs to a horizontal or multilateral wellbore configuration. It is to be understood that a multilateral wellbore configuration includes at least two principal wellbores connected by one or more ancillary wellbores.

Figure 2:
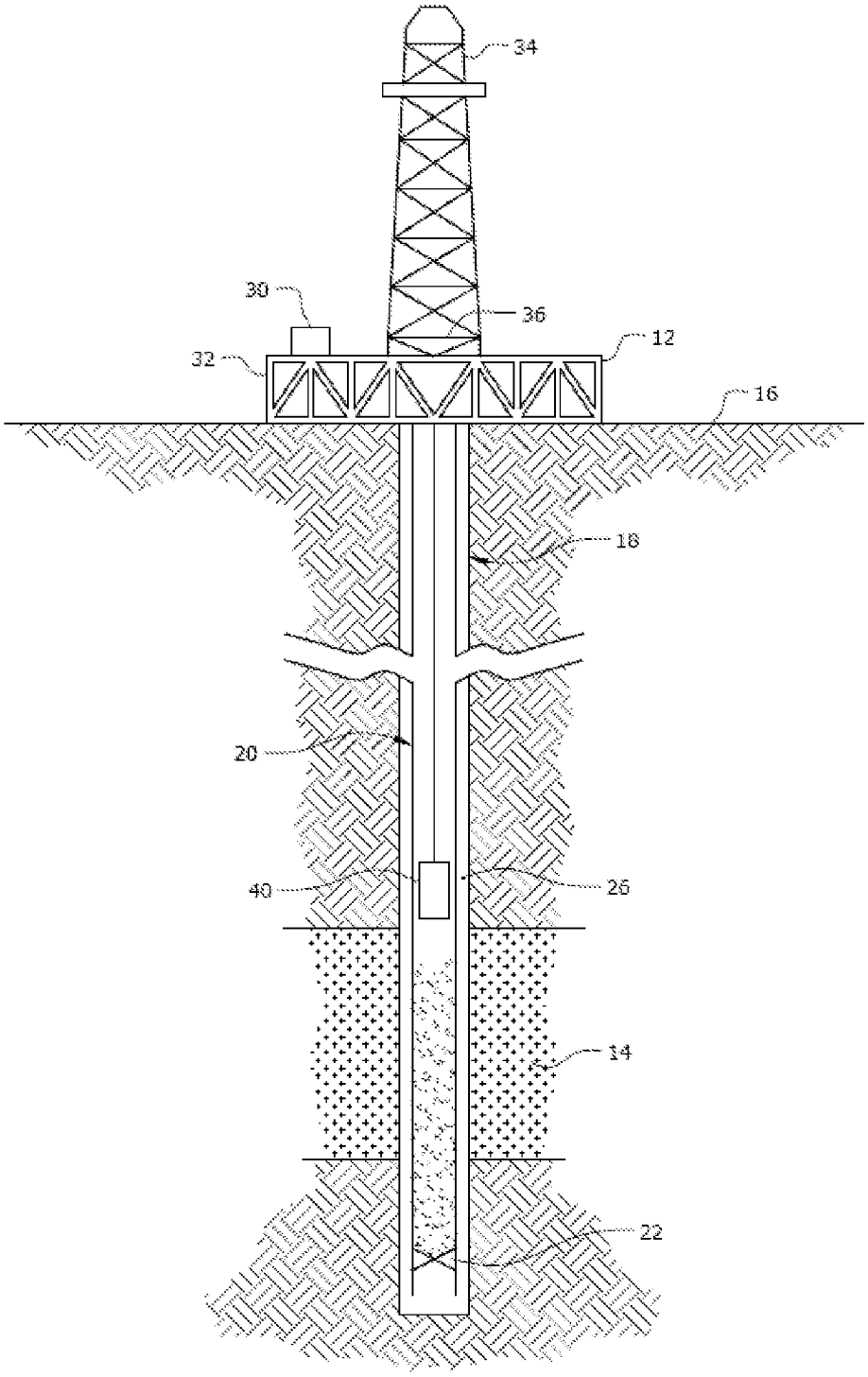
FIG. 2 is a schematic of a typical onshore oil or gas drilling rig and wellbore.

FIG. 2, which shows a typical onshore oil or gas drilling rig and wellbore, will be used to clarify the methods of the present disclosure, with the understanding that the present disclosure is likewise applicable to offshore rigs and wellbores. Rig 12 is centered over a subterranean oil or gas formation 14 located below the earth's surface 16. Rig 12 includes a work deck 32 that supports a derrick 34. Derrick 34 supports a hoisting apparatus 36 for raising and lowering pipe strings such as casing 20. Pump 30 is capable of pumping a variety of wellbore compositions (e.g., drilling fluid or cement) into the well and includes a pressure measurement device that provides a pressure reading at the pump discharge. Wellbore 18 has been drilled through the various earth strata, including formation 14. Upon completion of wellbore drilling, casing 20 is often placed in the wellbore 18 to facilitate the production of oil and gas from the formation 14. Casing 20 is a string of pipes that extends down wellbore 18, through which oil and gas will eventually be extracted. A cement or casing shoe 22 is typically attached to the end of the casing string when the casing string is run into the wellbore 18. Casing shoe 22 guides casing 20 toward the center of the hole and minimizes problems associated with hitting rock ledges or washouts in wellbore 18 as the casing string 20 is lowered into the well. Casing shoe, 22, may be a guide shoe or a float shoe, and typically comprises a tapered, often bullet-nosed piece of equipment found on the bottom of casing string 20. Casing shoe, 22, may be a float shoe fitted with an open bottom and a valve that serves to prevent reverse flow, or U-tubing, of cement slurry from annulus 26 into casing 20 as casing 20 is run into wellbore 18. The region between casing 20 and the wall of wellbore 18 is known as the casing annulus 26. To fill up casing annulus 26 and secure casing 20 in place, casing 20 is usually "cemented" in wellbore 18, which is referred to as "primary cementing." A data interrogator tool 40 is shown in the wellbore 18.

In an embodiment, the method of this disclosure is used for monitoring primary cement during and/or subsequent to a conventional primary cementing operation. In this conventional primary cementing embodiment, sensors coated with an elastomer are mixed into a cement slurry, block 102 of FIG. 1, and the cement slurry is then pumped down the inside of casing 20, block 104 of FIG. 1. As the slurry reaches the bottom of casing 20, it flows out of casing 20 and into casing annulus 26 between casing 20 and the wall of wellbore 18. As cement slurry flows up annulus 26, it displaces any fluid in the wellbore 18. To ensure no cement remains inside casing 20, devices called "wipers" may be pumped by a wellbore servicing fluid (e.g., drilling mud) through casing 20 behind the cement. The wiper contacts the inside surface of casing 20 and pushes any remaining cement out of casing 20. When cement slurry reaches the earth's surface 16, and annulus 26 is filled with slurry, pumping is terminated and the cement is allowed to set. The elastomer-coated sensors of the present disclosure may also be used to determine one or more parameters during placement and/or curing of the cement slurry. Also, the elastomer-coated sensors of the present disclosure may also be used to determine completion of the primary cementing operation, as further discussed herein below.

During cementing, or subsequent the setting of cement, a data interrogator tool 40 may be positioned in wellbore 18, as described at block 106 of FIG. 1. In embodiments such as that shown in FIG. 2, the interrogator tool 40 may be run downhole via a wireline or other conveyance. In alternative embodiments, the wiper may be equipped with a data interrogator tool 40 and may read data from the elastomer-coated sensors while being pumped downhole and transmit same to the surface. In alternative embodiments, an interrogator tool 40 may be run into the wellbore 18 following completion of cementing a segment of casing, for example as part of the drill string during resumed drilling operations. The data interrogator tool 40 may then be signaled to interrogate the elastomer-coated sensors (as described at block 108 of FIG. 1) whereby the elastomer-coated sensors are activated to record and/or transmit data (as described in block 110 of FIG. 1). The data interrogator tool 40 communicates the data to computer (e.g., a processor) whereby data sensor (and likewise cement slurry) position and cement integrity may be determined (e.g., calculated as described at block 112 of FIG. 1) via analyzing sensed parameters for changes, trends, expected values, etc. For example, such data may reveal conditions that may be adverse to cement curing. The elastomer-coated sensors may provide a temperature profile over the length of the cement sheath, with a uniform temperature profile likewise indicating a uniform cure (e.g., produced via heat of hydration of the cement during curing) or a cooler zone might indicate the presence of water that may degrade the cement during the transition from slurry to set cement. Alternatively, such data may indicate a zone of reduced, minimal, or missing sensors, which would indicate a loss of cement corresponding to the area (e.g., a loss/void zone or water influx/washout). Alternatively, such data may indicate swelling or expansion of the elastomer in the cement due to, for example, the presence of a hydrocarbon in a crack, void, gap, etc. of the cement. Such methods may be available with various cement techniques described herein such as conventional or reverse primary cementing.

Due to the high pressure at which the cement is pumped during conventional primary cementing (pump down the casing and up the annulus), fluid from the cement slurry may leak off into existing low pressure zones traversed by the wellbore 18. This may adversely affect the cement, and incur undesirable expense for remedial cementing operations (e.g., squeeze cementing as discussed hereinbelow) to position the cement in the annulus. Such leak off may be detected via the present disclosure as described previously. For example, the elastomer may expand or compress indicating a change in density of the cement after the fluid leaks off. Additionally, conventional circulating cementing may be time-consuming, and therefore relatively expensive, because cement is pumped all the way down casing 20 and back up annulus 26.

One method of avoiding problems associated with conventional primary cementing is to employ reverse circulation primary cementing. Reverse circulation cementing is a term of art used to describe a method where a cement slurry is pumped down casing annulus 26 instead of into casing 20. The cement slurry displaces any fluid as it is pumped down annulus 26. Fluid in the annulus is forced down annulus 26, into casing 20 (along with any fluid in the casing), and then back up to earth's surface 16. When reverse circulation cementing, casing shoe 22 comprises a valve that is adjusted to allow flow into casing 20 and then sealed after the cementing operation is complete. Once slurry is pumped to the bottom of casing 20 and fills annulus 26, pumping is terminated and the cement is allowed to set in annulus 26. Examples of reverse cementing applications are disclosed in U.S. Pat. Nos. 6,920,929 and 6,244,342, each of which is incorporated herein by reference in its entirety.

In embodiments of the present disclosure, a sealant comprising elastomer-coated data sensors (e.g., a sealant slurry) is pumped down the annulus 26 in reverse circulation applications, a data interrogator 40 is located within the wellbore 18 (e.g., by wireline as shown in FIG. 2 or integrated into the casing shoe) and sealant performance is monitored as described with respect to the conventional primary sealing method disclosed hereinabove. Additionally, the elastomer-coated data sensors of the present disclosure may also be used to determine completion of a reverse circulation operation, as further discussed hereinbelow.

Secondary cementing within a wellbore (e.g., wellbore 18) may be carried out subsequent to primary cementing operations. A common example of secondary cementing is squeeze cementing wherein a sealant such as a cement composition is forced under pressure into one or more permeable zones within the wellbore to seal such zones. Examples of such permeable zones include fissures, cracks, fractures, streaks, flow channels, voids, high permeability streaks, annular voids, or combinations thereof. The permeable zones may be present in the cement column residing in the annulus, a wall of the conduit in the wellbore, a microannulus between the cement column and the subterranean formation, and/or a microannulus between the cement column and the conduit. The sealant (e.g., secondary cement composition) sets within the permeable zones, thereby forming a hard mass to plug those zones and prevent fluid from passing therethrough (i.e., prevents communication of fluids between the wellbore and the formation via the permeable zone). Various procedures that may be followed to use a sealant composition in a wellbore are described in U.S. Pat. No. 5,346,012, which is incorporated by reference herein in its entirety. In various embodiments, a sealant composition comprising elastomer-coated sensors is used to repair holes, channels, voids, and microannuli in casing, cement sheath, gravel packs, and the like as described in U.S. Pat. Nos. 5,121,795; 5,123,487; and 5,127,473, each of which is incorporated by reference herein in its entirety.

In embodiments, the method of the present disclosure may be employed in a secondary cementing operation. In these embodiments, data sensors are mixed with a sealant composition (e.g., a secondary cement slurry) at block 102 of FIG. 1 and subsequent or during positioning and hardening of the cement, the sensors are interrogated to monitor the performance of the secondary cement in an analogous manner to the incorporation and monitoring of the data sensors in primary cementing methods disclosed hereinabove. For example, the elastomer-coated sensors may be used to verify that the secondary sealant is functioning properly and/or to monitor its long-term integrity.

In embodiments, the methods of the present disclosure are utilized for monitoring cementitious sealants (e.g., hydraulic cement), non-cementitious (e.g., polymer, latex or resin systems), or combinations thereof comprising one or more elastomer-coated sensors, which may be used in primary, secondary, or other sealing applications. For example, expandable tubulars such as pipe, pipe string, casing, liner, or the like are often sealed in a subterranean formation. The expandable tubular (e.g., casing) is placed in the wellbore, a sealing composition is placed into the wellbore, the expandable tubular is expanded, and the sealing composition is allowed to set in the wellbore. For example, after expandable casing is placed downhole, a mandrel may be run through the casing to expand the casing diametrically, with expansions up to 25% possible. The expandable tubular may be placed in the wellbore before or after placing the sealing composition in the wellbore. The expandable tubular may be expanded before, during, or after the set of the sealing composition. When the tubular is expanded during or after the set of the sealing composition, resilient compositions will remain competent due to their elasticity and compressibility. Additional tubulars may be used to extend the wellbore into the subterranean formation below the first tubular as is known to those of skill in the art. Sealant compositions and methods of using the compositions with expandable tubulars are disclosed in U.S. Pat. Nos. 6,722,433 and 7,040,404 and U.S. Pat. Pub. No. 2004/0167248, each of which is incorporated by reference herein in its entirety. In expandable tubular embodiments, the sealants may comprise compressible hydraulic cement compositions and/or non-cementitious compositions.

Compressible hydraulic cement compositions (for example, compressible foamed sealants) have been developed which remain competent (continue to support and seal the pipe) when compressed, and such compositions may comprise sensors coated with an elastomer. The sealant composition is placed in the annulus between the wellbore and the pipe or pipe string, the sealant composition is allowed to harden into an impermeable mass, and thereafter, the expandable pipe or pipe string is expanded whereby the hardened sealant composition is compressed, as is the elastomer coating of the sensors within the sealant composition. In embodiments, the compressible foamed sealant comprises a hydraulic cement, a rubber latex, a rubber latex stabilizer, a gas and a mixture of foaming and foam stabilizing surfactants. Suitable hydraulic cements include, but are not limited to, Portland cement and calcium aluminate cement.

Often, non-cementitious resilient sealants with comparable strength to cement, but greater elasticity and compressibility, are required for cementing expandable casing. In embodiments, these sealants comprise polymeric sealing compositions, and such polymeric sealing compositions may be mixed with elastomer-coated sensors. In an embodiment, the sealant comprises a polymer and a metal containing compound. In embodiments, the polymer comprises copolymers, terpolymers, and interpolymers. The metal-containing compounds may comprise zinc, tin, iron, selenium magnesium, chromium, or cadmium. The compounds may be in the form of an oxide, carboxylic acid salt, a complex with dithiocarbamate ligand, or a complex with mercaptobenzothiazole ligand. In embodiments, the sealant comprises a mixture of latex, dithio carbamate, zinc oxide, and sulfur.

In embodiments, the methods of the present disclosure comprise adding elastomer-coated data sensors to a sealant to be used behind expandable casing to monitor the integrity of the sealant upon expansion of the casing and during the service life of the sealant. In this embodiment, the sensors may comprise sensors (e.g., MEMS sensors) capable of measuring one or more parameters, for example, expansion or swelling of the elastomer, compression of the elastomer, the presence of hydrocarbon, moisture, temperature change, or combinations thereof. If the sealant develops cracks, the cracks may be detected by expansion or compression of the elastomer-coated sensors. Water influx in the crack may be detected via, for example, moisture and/or temperature indication. Hydrocarbon influx in the crack may be detected via, for example, elastomer swelling and/or temperature indication.

In an embodiment, the elastomer-coated sensors are added to one or more wellbore servicing compositions used or placed downhole in drilling or completing a monodiameter wellbore as disclosed in U.S. Pat. No. 7,066,284 and U.S. Pat. Pub. No. 2005/0241855, each of which is incorporated by reference herein in its entirety. In an embodiment, the elastomer-coated sensors are included in a chemical casing composition used in a monodiameter wellbore. In another embodiment, the elastomer-coated sensors are included in wellbore servicing compositions (e.g., sealants) used to place expandable casing or tubulars in a monodiameter wellbore.

Examples of chemical casings are disclosed in U.S. Pat. Nos. 6,702,044; 6,823,940; and 6,848,519, each of which is incorporated herein by reference in its entirety.

In one embodiment, the elastomer-coated sensors are used to gather wellbore servicing composition (e.g., sealant) data and monitor the long-term integrity of the composition (e.g., sealant) placed in a wellbore, for example a wellbore for the recovery of natural resources such as water or hydrocarbons or an injection well for disposal or storage. In an embodiment, data/information gathered and/or derived from the elastomer-coated sensors in the composition (e.g., a downhole wellbore sealant) comprises at least a portion of the input and/or output to into one or more calculators, simulations, or models used to predict, select, and/or monitor the performance of wellbore sealant compositions over the life of a well. Such models and simulators may be used to select a composition comprising elastomer-coated sensors for use in a wellbore. After placement in the wellbore, the elastomer-coated sensors may provide data that can be used to refine, recalibrate, or correct the models and simulators. Furthermore, the elastomer-coated sensors can be used to monitor and record the downhole conditions that the sealant is subjected to, and sealant performance may be correlated to such long term data to provide an indication of problems or the potential for problems in the same or different wellbores. In various embodiments, data gathered from elastomer-coated sensors is used to select a sealant composition or otherwise evaluate or monitor such sealants, as disclosed in U.S. Pat. Nos. 6,697,738; 6,922,637; and 7,133,778, each of which is incorporated by reference herein in its entirety.

In an embodiment, the compositions and methodologies of this disclosure are employed via an operating environment that generally comprises a wellbore that penetrates a subterranean formation for the purpose of recovering hydrocarbons, storing hydrocarbons, injection of carbon dioxide, storage of carbon dioxide, disposal of carbon dioxide, and the like, and the elastomer-coated sensors may provide information as to a condition and/or location of the composition and/or the subterranean formation. For example, the elastomer-coated sensors may provide information as to a location, flow path/profile, volume, density, temperature, pressure, or a combination thereof of a hydrocarbon (e.g., natural gas stored in a salt dome) or carbon dioxide placed in a subterranean formation such that effectiveness of the placement may be monitored and evaluated, for example detecting leaks, determining remaining storage capacity in the formation, etc. In some embodiments, the compositions of this disclosure are employed in an enhanced oil recovery operation wherein a wellbore that penetrates a subterranean formation may be subjected to the injection of gases (e.g., carbon dioxide) so as to improve hydrocarbon recovery from said wellbore, and the elastomer-coated sensors may provide information as to a condition and/or location of the composition and/or the subterranean formation. For example, the elastomer-coated sensors may provide information as to a location, flow path/profile, volume, density, temperature, pressure, or a combination thereof of carbon dioxide used in a carbon dioxide flooding enhanced oil recovery operation in real time such that the effectiveness of such operation may be monitored and/or adjusted in real time during performance of the operation to improve the result of same.

Figure 4:
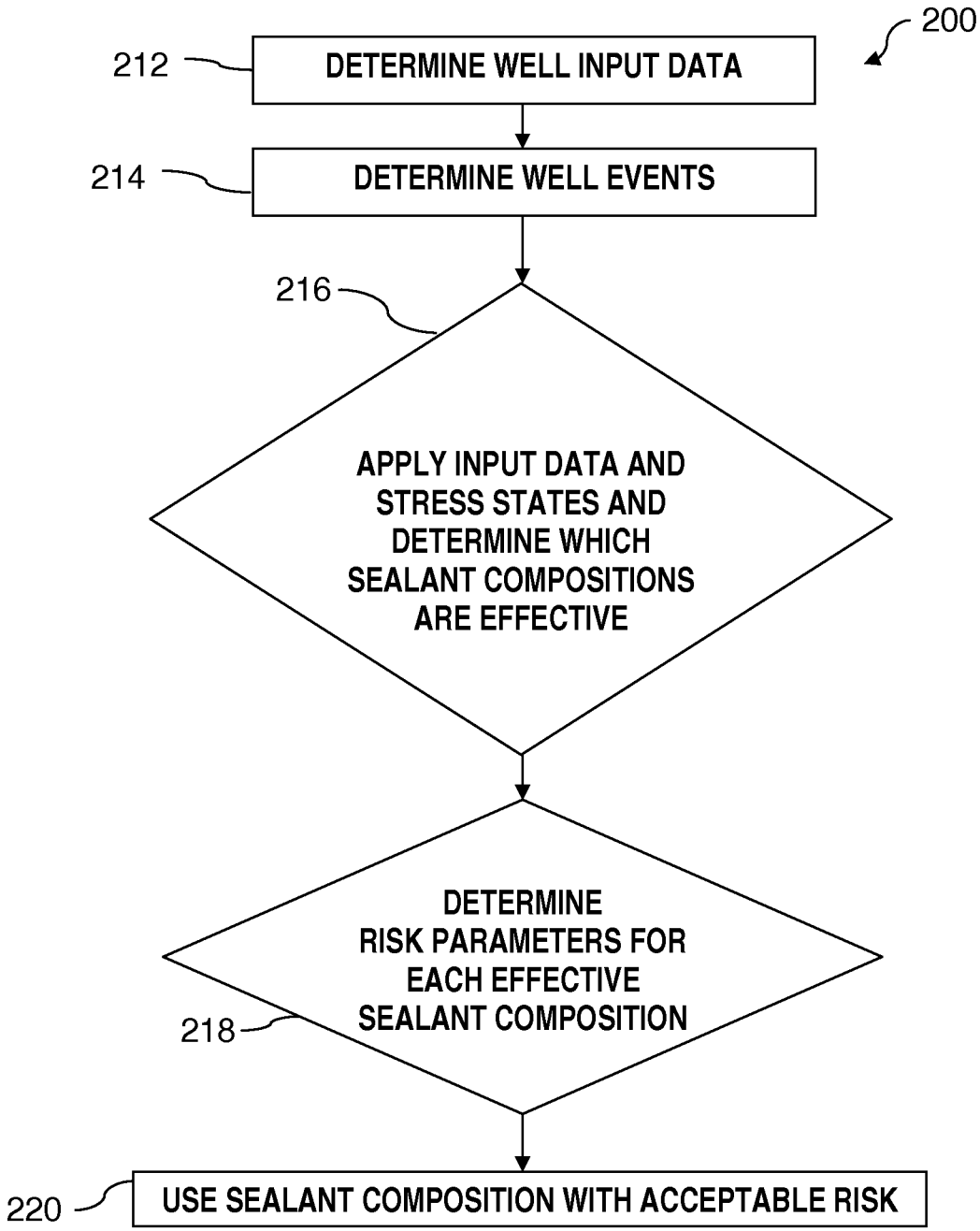
FIG. 4 is a flowchart of a method for selecting between a group of sealant compositions according to one embodiment of the present disclosure.

Referring to FIG. 4, a method 200 for selecting a sealant (e.g., a cementing composition) for sealing a subterranean zone penetrated by a wellbore according to the present embodiment basically comprises determining a group of effective compositions from a group of compositions given estimated conditions experienced during the life of the well, and estimating the risk parameters for each of the group of effective compositions. In an alternative embodiment, actual measured conditions experienced during the life of the well, in addition to or in lieu of the estimated conditions, may be used. Such actual measured conditions may be obtained for example via compositions (e.g., sealants) comprising sensors coated with an elastomer as described herein. Effectiveness considerations include concerns that the sealant composition be stable under downhole conditions of pressure and temperature, resist downhole chemicals, and possess the mechanical properties to withstand stresses from various downhole operations to provide zonal isolation for the life of the well.

In step 212, well input data for a particular well is determined. Well input data includes routinely measurable or calculable parameters inherent in a well, including vertical depth of the well, overburden gradient, pore pressure, maximum and minimum horizontal stresses, hole size, casing outer diameter, casing inner diameter, density of drilling fluid, desired density of sealant slurry for pumping, density of completion fluid, and top of sealant. As will be discussed in greater detail with reference to step 214, the well can be computer modeled. In modeling, the stress state in the well at the end of drilling, and before the sealant slurry is pumped into the annular space, affects the stress state for the interface boundary between the rock and the sealant composition. Thus, the stress state in the rock with the drilling fluid is evaluated, and properties of the rock such as Young's modulus, Poisson's ratio, and yield parameters are used to analyze the rock stress state. These terms and their methods of determination are well known to those skilled in the art. It is understood that well input data will vary between individual wells. In an alternative embodiment, well input data includes data that is obtained via compositions comprising a sealant and elastomer-coated sensors as described herein.

In step 214, the well events applicable to the well are determined. For example, cement hydration (setting) is a well event. Other well events include pressure testing, well completions, hydraulic fracturing, hydrocarbon production, fluid injection, perforation, subsequent drilling, formation movement as a result of producing hydrocarbons at high rates from unconsolidated formation, and tectonic movement after the sealant composition has been pumped in place. Well events include those events that are certain to happen during the life of the well, such as cement hydration, and those events that are readily predicted to occur during the life of the well, given a particular well's location, rock type, and other factors well known in the art. In an embodiment, well events and data associated therewith may be obtained via compositions comprising a sealant and elastomer-coated sensors as described herein.

Each well event is associated with a certain type of stress, for example, cement hydration is associated with shrinkage, pressure testing is associated with pressure, well completions, hydraulic fracturing, and hydrocarbon production are associated with pressure and temperature, fluid injection is associated with temperature, formation movement is associated with load, and perforation and subsequent drilling are associated with dynamic load. As can be appreciated, each type of stress can be characterized by an equation for the stress state (collectively "well event stress states"), as described in more detail in U.S. Pat. No. 7,133,778 which is incorporated herein by reference in its entirety.

In step 216, the well input data, the well event stress states, and the sealant data are used to determine the effect of well events on the integrity of the sealant sheath during the life of the well for each of the sealant compositions. The sealant compositions that would be effective for sealing the subterranean zone and their capacity from its elastic limit are determined. In an alternative embodiment, the estimated effects over the life of the well are compared to and/or corrected in comparison to corresponding actual data gathered over the life of the well via compositions comprising a sealant and elastomer-coated sensors as described herein. Step 216 concludes by determining which sealant compositions would be effective in maintaining the integrity of the resulting cement sheath for the life of the well.

In step 218, parameters for risk of sealant failure for the effective sealant compositions are determined. For example, even though a sealant composition is deemed effective, one sealant composition may be more effective than another. In one embodiment, the risk parameters are calculated as percentages of sealant competency during the determination of effectiveness in step 216. In an alternative embodiment, the risk parameters are compared to and/or corrected in comparison to actual data gathered over the life of the well via compositions comprising a sealant and the elastomer-coated sensors as described herein.

Step 218 provides data that allows a user to perform a cost benefit analysis. Due to the high cost of remedial operations, it is important that an effective sealant composition is selected for the conditions anticipated to be experienced during the life of the well. It is understood that each of the sealant compositions has a readily calculable monetary cost. Under certain conditions, several sealant compositions may be equally efficacious, yet one may have the added virtue of being less expensive. Thus, it should be used to minimize costs. More commonly, one sealant composition will be more efficacious, but also more expensive. Accordingly, in step 220, an effective sealant composition with acceptable risk parameters is selected given the desired cost. Furthermore, the overall results of steps 200-220 can be compared to actual data that is obtained via compositions comprising a sealant composition and the elastomer-coated sensors as described herein, and such data may be used to modify and/or correct the inputs and/or outputs to the various steps 200-220 to improve the accuracy of same.

As discussed above and with reference to FIG. 2, wipers are often utilized during conventional primary cementing to force cement slurry out of the casing. The wiper plug also serves another purpose: typically, the end of a cementing operation is signaled when the wiper plug contacts a restriction (e.g., casing shoe) inside the casing 20 at the bottom of the string. When the plug contacts the restriction, a sudden pressure increase at pump 30 is registered. In this way, it can be determined when the cement has been displaced from the casing 20 and fluid flow returning to the surface via casing annulus 26 stops.

In reverse circulation cementing, it is also necessary to correctly determine when cement slurry completely fills the annulus 26. Continuing to pump cement into annulus 26 after cement has reached the far end of annulus 26 forces cement into the far end of casing 20, which could incur lost time if cement must be drilled out to continue drilling operations.

The methods disclosed herein may be utilized to determine when cement slurry has been appropriately positioned downhole. Furthermore, as discussed hereinbelow, the methods of the present disclosure may additionally comprise using a sensor coated with an elastomer to actuate a valve or other mechanical means to close and prevent cement from entering the casing upon determination of completion of a cementing operation.

Figure 3:
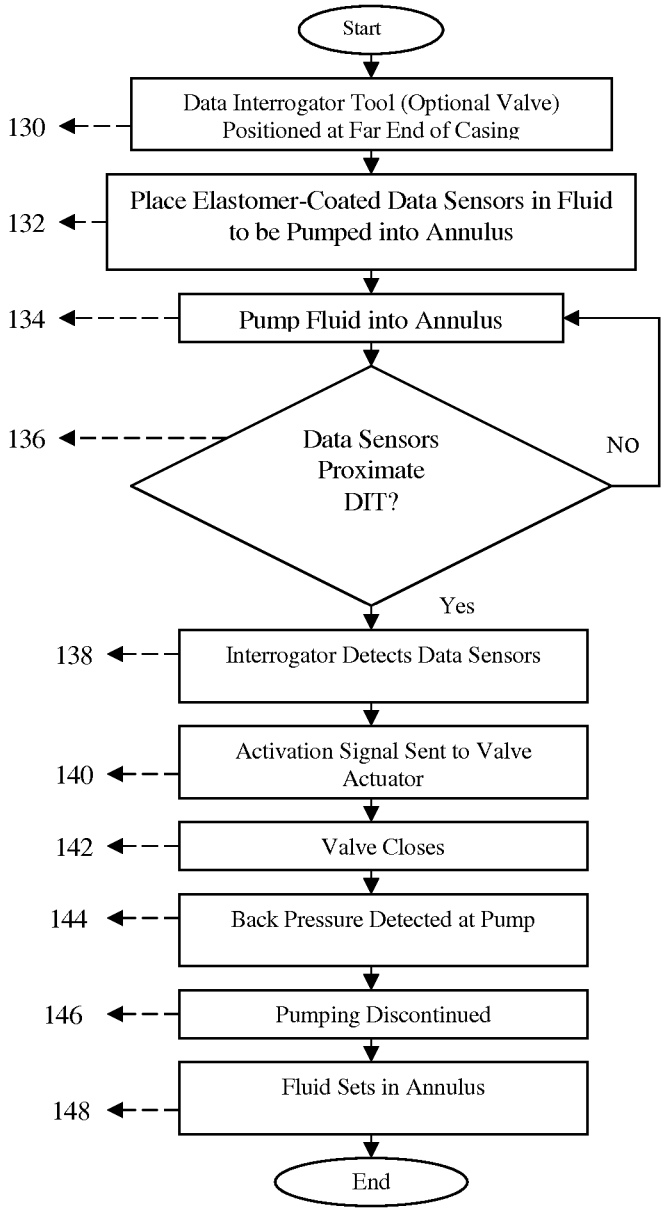
FIG. 3 is a flowchart detailing a method for determining when a reverse cementing operation is complete and for subsequent optional activation of a downhole tool.

The way in which the method of the present disclosure may be used to signal when cement is appropriately positioned within annulus 26 will now be described within the context of a reverse circulation cementing operation. FIG. 3 is a flowchart of a method for determining completion of a cementing operation and optionally further actuating a downhole tool upon completion (or to initiate completion) of the cementing operation. This description will reference the flowchart of FIG. 3, as well as the wellbore depiction of FIG. 2.

At block 130, a data interrogator tool as described hereinabove is positioned at the far end of casing 20. In an embodiment, the data interrogator tool is incorporated with or adjacent to a casing shoe positioned at the bottom end of the casing and in communication with operators at the surface. At block 132, elastomer-coated sensors are added to a wellbore servicing fluid (e.g., drilling fluid, completion fluid, cement slurry, spacer fluid, displacement fluid, etc.) to be pumped into annulus 26. At block 134, cement slurry is pumped into annulus 26. In an embodiment, the elastomer-coated sensors may be placed in substantially all of the cement slurry pumped into the wellbore. In an alternative embodiment, the elastomer-coated sensors may be placed in a leading plug or otherwise placed in an initial portion of the cement to indicate a leading edge of the cement slurry. In an embodiment, elastomer-coated sensors are placed in leading and trailing plugs to signal the beginning and end of the cement slurry. While cement is continuously pumped into annulus 26, at decision 136, the data interrogator tool is attempting to detect whether the data sensors are in communicative proximity with the data interrogator tool. As long as no data sensors are detected, the pumping of additional cement into the annulus continues. When the data interrogator tool detects the sensors at block 138 indicating that the leading edge of the cement has reached the bottom of the casing, the interrogator sends a signal to terminate pumping. The cement in the annulus is allowed to set and form a substantially impermeable mass which physically supports and positions the casing in the wellbore and bonds the casing to the walls of the wellbore in block 148.

If the fluid of block 130 is the cement slurry, elastomer-coated (e.g., MEMS-based) data sensors are incorporated within the set cement, and parameters of the cement (e.g., cracks, temperature, pressure, ion concentration, stress, strain, presence of hydrocarbon, etc.) can be monitored during placement and for the duration of the service life of the cement according to methods disclosed hereinabove. Alternatively, the elastomer-coated data sensors may be added to an interface fluid (e.g., spacer fluid or other fluid plug) introduced into the annulus prior to and/or after introduction of cement slurry into the annulus.

The method just described for determination of the completion of a primary wellbore cementing operation may further comprise the activation of a downhole tool. For example, at block 130, a valve or other tool may be operably associated with a data interrogator tool at the far end of the casing. This valve may be contained within float shoe 22, for example, as disclosed hereinabove. Again, float shoe 22 may contain an integral data interrogator tool, or may otherwise be coupled to a data interrogator tool. For example, the data interrogator tool may be positioned between casing 20 and float shoe 22. Following the method previously described and blocks 132 to 136, pumping continues as the data interrogator tool detects the presence or absence of data sensors in close proximity to the interrogator tool (dependent upon the specific method cementing method being employed, e.g., reverse circulation, and the positioning of the sensors within the cement flow). Upon detection of a determinative presence or absence of sensors in close proximity indicating the termination of the cement slurry, the data interrogator tool sends a signal to actuate the tool (e.g., valve) at block 140. At block 142, the valve closes, sealing the casing and preventing cement from entering the portion of casing string above the valve in a reverse cementing operation. At block 144, the closing of the valve at 142, causes an increase in back pressure that is detected at the hydraulic pump 30. At block 146, pumping is discontinued, and cement is allowed to set in the annulus at block 148. In embodiments wherein data sensors have been incorporated throughout the cement, parameters of the cement (and thus cement integrity) can additionally be monitored during placement and for the duration of the service life of the cement according to methods disclosed hereinabove.

Improved methods of monitoring the condition from placement through the service lifetime of the wellbore servicing compositions disclosed herein provide a number of advantages. Such methods are capable of detecting changes in parameters in the wellbore servicing compositions described herein, such as integrity (e.g., cracks), density, present or absence of a fluid (e.g., hydrocarbon or water), moisture content, temperature, pH, and the concentration of ions (e.g., chloride, sodium, and potassium ions). Such methods provide this data for monitoring the condition of the wellbore servicing compositions from the initial quality control period during mixing and/or placement, through the compositions' useful service life, and through its period of deterioration and/or repair. Such methods also provide this data for monitoring the condition of compositions during drilling operations, completion operations, production operations, or combinations thereof. Such methods are cost efficient and allow determination of real-time data using sensors capable of functioning without the need for a direct power source (i.e., passive rather than active sensors), such that sensor size be minimal to maintain sealant strength and sealant slurry pumpability. The use of elastomer-coated sensors for determining wellbore characteristics or parameters may also be utilized in methods of pricing a well servicing treatment, selecting a treatment for the well servicing operation, and/or monitoring a well servicing treatment during real-time performance thereof, for example, as described in U.S. Pat. Pub. No. 2006/0047527 A1, which is incorporated by reference herein in its entirety.

The wellbore servicing compositions (e.g., a cementitious or a non-cementitious resilient sealant, as discussed above) and elastomer-coated sensors also include various advantages. For example, the elastomer coating of the sensors can protect and maintain the integrity of the sensors in the wellbore servicing fluid due to the resilient nature of elastomers while also functioning as a part of the sensor (e.g., expanding, swelling, or compressing to indicate a change in one or more of the parameters disclosed hereinabove). Moreover, a composition can optionally have one or two mechanisms of resilience: i) resilience in the elastomer coating of the elastomer-coated sensors, and optionally, ii) resilience in the wellbore servicing fluid itself (e.g., a foamed and/or polymeric sealing composition). Additionally, the use of non-silicon based sensors as described hereinabove allows for the use of elastomer-coated sensors in thicker compositions and/or in scenarios where the distance between a communication tool (e.g., the interrogator disclosed herein) and the elastomer-coated sensors is such that other sensor types may not be able to communicate information.

While various embodiments of the methods have been shown and described, modifications thereof can be made by one skilled in the art without departing from the spirit and teachings of the present disclosure. The embodiments described herein are exemplary only, and are not intended to be limiting. Many variations and modifications of the methods disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural or other details supplementary to those set forth herein.

The following are additional enumerated embodiments according to the present disclosure:

A first embodiment which is method comprising placing a wellbore servicing composition comprising a plurality of elastomer-coated sensors in a wellbore, a subterranean formation, or both.

A second embodiment which is the method of the first embodiment further comprising the step of using the elastomer-coated sensors to detect one or more parameters.

A third embodiment with is the method of the second embodiment wherein the one or more parameters comprises a compression of the elastomer.

A fourth embodiment which is the method of the second embodiment wherein the one or more parameters comprises an expansion or swelling of the elastomer.

A fifth embodiment which is the method of the second embodiment wherein the wellbore servicing composition comprises a base fluid, wherein the one or more parameters comprises a change in a density of the composition.

A sixth embodiment which is the method of any preceding embodiment wherein the wellbore servicing composition is formulated as a drilling fluid, a spacer fluid, a sealant, a fracturing fluid, a gravel pack fluid, or a completion fluid.

A seventh embodiment which is the method of any one of the first to fifth embodiments wherein the wellbore servicing composition is a sealant, the method further comprising the step of allowing the sealant to set.

An eighth embodiment which is the method of any preceding embodiment wherein the elastomer-coated sensors comprise a Micro-Electro-Mechanical System (MEMS) sensor, an LCD sensor, a conductive polymer sensor, a bio-polymer sensor, or combinations thereof.

A ninth embodiment which is the method of any preceding embodiment wherein the composition is placed in a $CO_2$ injection, storage, or disposal well.

A tenth embodiment which is the method of any preceding embodiment further comprising the step of using an interrogator to communicate with the elastomer-coated sensors.

An eleventh embodiment which is the method of any preceding embodiment wherein the wellbore servicing composition comprises a plurality of elastomer-coated MEMS sensors in an amount from about 0.001 to about 10 weight percent of the composition, wherein the plurality of elastomer-coated MEMS sensors are approximately 0.01 $mm^2$ to approximately 10 $mm^2$ in size.

A twelfth embodiment which is a wellbore servicing composition comprising a base fluid a plurality of elastomer-coated sensors.

A thirteenth embodiment which is the composition of twelfth embodiment wherein the sensors comprise, a Micro-Electro-Mechanical System (MEMS) sensor, an LCD sensor, a conductive polymer sensor, a bio-polymer sensor, or combinations thereof.

A fourteenth embodiment which is the composition of the twelfth or thirteenth embodiment wherein the elastomer-coated sensors are approximately 0.01 $mm^2$ to approximately 10 $mm^2$ in size, wherein the elastomer-coated sensors comprise an amount from about 0.001 to about 10 weight percent of the composition.

A fifteenth embodiment which is the composition any one of the twelfth to fourteenth embodiments wherein the elastomer has a specific gravity in the range of about 0.05 to about 2.00.

A sixteenth embodiment which is the composition of any one of the twelfth to fifteenth embodiments wherein the elastomer comprises a copolymer of styrene and divinylbenzene; a copolymer of methylmethacrylate and acrylonitrile; a copolymer of styrene and acrylonitrile; a terpolymer of methylmethacrylate, acrylonitrile, and vinylidene dichloride; a terpolymer of styrene, vinylidene chloride, and acrylonitrile; a phenolic resin; polystyrene; a WellLife® material; or combinations thereof.

A seventeenth embodiment which is the composition of any one of the twelfth to sixteenth embodiments wherein the sensors detect a change in a density of the composition upon a compression or expansion of the elastomer.

An eighteenth embodiment which is the composition of any one of the twelfth to seventeenth embodiments wherein the sensors detect a compression of the elastomer.

A nineteenth embodiment which is the composition of any one of the twelfth to eighteenth embodiments wherein the sensors detect an expansion or swelling of the elastomer.

A twentieth embodiment which is the composition of any one of the twelfth to nineteenth embodiments wherein the wellbore servicing composition is formulated as a drilling fluid, a spacer fluid, a sealant, a fracturing fluid, a gravel pack fluid, or a completion fluid.

What is claimed is:

1. A method comprising:

placing a wellbore servicing composition comprising a plurality of elastomer-coated sensors in a wellbore, a subterranean formation, or both; and using the elastomer-coated sensors to detect one or more parameters, wherein the one or more parameters includes a change in the elastomer.

2. The method of claim 1 wherein the change in the elastomer comprises a compression of the elastomer.

3. The method of claim 1 wherein the change in the elastomer comprises an expansion or swelling of the elastomer.

4. The method of claim 1 wherein the wellbore servicing composition is formulated as a drilling fluid, a spacer fluid, a sealant, a fracturing fluid, a gravel pack fluid, or a completion fluid.

5. The method of claim 1 wherein the wellbore servicing composition is a sealant, the method further comprising the step of allowing the sealant to set.

6. The method of claim 1 wherein the elastomer-coated sensors comprise a Micro-Electro-Mechanical System (MEMS) sensor, a liquid crystal display (LCD) sensor, a conductive polymer sensor, a bio-polymer sensor, or combinations thereof.

7. The method of claim 1 wherein the composition is placed in a CO2 injection, storage, or disposal well.

8. The method of claim 1 further comprising the step of using an interrogator to communicate with the elastomer-coated sensors.

9. The method of claim 1 wherein the wellbore servicing composition comprises a plurality of elastomer-coated MEMS sensors in an amount from about 0.001 to about 10 weight percent of the composition, wherein the plurality of elastomer-coated MEMS sensors are approximately 0.01 $mm^2$ to approximately 10 $mm^2$ in size.

10. The method of claim 1 wherein the one or more parameters further comprises a change in the wellbore servicing composition.

11. A wellbore servicing composition comprising:

a base fluid; and a plurality of elastomer-coated sensors, wherein each of the plurality of elastomer-coated sensors is configured to detect one or more parameters, the one or more parameters including a change in the elastomer.

12. The composition of claim 11 wherein the sensors comprise, a Micro-Electro-Mechanical System (MEMS) sensor, an LCD sensor, a conductive polymer sensor, a bio-polymer sensor, or combinations thereof.

13. The composition of claim 11 wherein the elastomer-coated sensors are approximately 0.01 $mm^2$ to approximately 10 $mm^2$ in size, wherein the elastomer-coated sensors comprise an amount from about 0.001 to about 10 weight percent of the composition.

14. The composition of claim 11 wherein the elastomer has a specific gravity in the range of about 0.05 to about 2.00, relative to water.

15. The composition of claim 11 wherein the elastomer comprises a copolymer of styrene and divinylbenzene; a copolymer of methylmethacrylate and acrylonitrile; a copolymer of styrene and acrylonitrile; a terpolymer of methylmethacrylate, acrylonitrile, and vinylidene dichloride; a terpolymer of styrene, vinylidene chloride, and acrylonitrile; a phenolic resin; polystyrene; a WellLife® material; or combinations thereof.

16. The composition of claim 11 wherein the sensors detect a change in a density of the composition upon a compression or expansion of the elastomer.

17. The composition of claim 11 wherein the change in the elastomer comprises a compression of the elastomer.

18. The composition of claim 11 wherein the change in the elastomer comprises an expansion or swelling of the elastomer.

19. The composition of claim 11 wherein the wellbore servicing composition is formulated as a drilling fluid, a spacer fluid, a sealant, a fracturing fluid, a gravel pack fluid, or a completion fluid.

20. The method of claim 10 wherein the change in the wellbore servicing composition comprises a change in a density of the composition.

* * * * *